US011296463B2

(12) United States Patent
Keith et al.

(10) Patent No.: US 11,296,463 B2
(45) Date of Patent: Apr. 5, 2022

(54) CONNECTORS FOR A SINGLE TWISTED PAIR OF CONDUCTORS

(71) Applicant: COMMSCOPE TECHNOLOGIES LLC, Hickory, NC (US)

(72) Inventors: Scott Martin Keith, Plano, TX (US); Amid Ihsan Hashim, Plano, TX (US)

(73) Assignee: COMMSCOPE TECHNOLOGIES LLC, Hickory, NC (US)

( * ) Notice: Subject to any disclaimer, the term of this patent is extended or adjusted under 35 U.S.C. 154(b) by 0 days.

(21) Appl. No.: 16/964,730

(22) PCT Filed: Jan. 24, 2019

(86) PCT No.: PCT/US2019/014906
§ 371 (c)(1),
(2) Date: Jul. 24, 2020

(87) PCT Pub. No.: WO2019/147774
PCT Pub. Date: Aug. 1, 2019

(65) Prior Publication Data

US 2020/0350730 A1 Nov. 5, 2020

Related U.S. Application Data

(60) Provisional application No. 62/622,562, filed on Jan. 26, 2018.

(51) Int. Cl.
*H01R 13/642* (2006.01)
*H01R 24/20* (2011.01)
(Continued)

(52) U.S. Cl.
CPC ..... *H01R 13/642* (2013.01); *H01R 24/20* (2013.01); *H01R 24/28* (2013.01); *H01R 24/60* (2013.01); *H01R 13/6463* (2013.01)

(58) Field of Classification Search
CPC .. H01R 13/2442; H01R 13/28; H01R 13/642; H01R 13/6461; H01R 13/6463; H01R 24/20; H01R 24/28; H01R 24/60
See application file for complete search history.

(56) References Cited

U.S. PATENT DOCUMENTS 2,673,968 A 3/1954 Smith
2,813,257 A 11/1957 Cornell, Jr.
(Continued)

FOREIGN PATENT DOCUMENTS

CN 1408135 A 4/2003
CN 106415944 A 2/2017
(Continued)

OTHER PUBLICATIONS

US 6,888,535 B2, 05/2005, Hohl et al. (withdrawn)
(Continued)

*Primary Examiner* — Oscar C Jimenez
(74) *Attorney, Agent, or Firm* — Merchant & Gould P.C.

(57) ABSTRACT

A family of connectors includes a plug, receptacle and adapter with the plug incorporating beam contacts, and the receptacle and adapter incorporating interfacing arched beam contacts. A z-configuration of the port(s) within the receptacle and adapter is configured to interface with the plug, which also presents a z-configuration. The parallel, upper and lower portions of the z-configuration of the plug incorporate the beam contacts. The first beam contact of the plug is rotated 180 degrees from the second beam contact of the plug; the arched beam contacts are similarly rotated. The plug, receptacle and adapter of a small form factor that is similar or identical to the formal factor of an optical fiber LC connector. The plug and receptacle can be configured for
(Continued)

circuit board, cable or patch cord mounting. The plug and receptacle can be utilized in a multi-plug/multi-receptacle configuration.

17 Claims, 20 Drawing Sheets

(51) Int. Cl.
*H01R 24/28* (2011.01)
*H01R 24/60* (2011.01)
*H01R 13/6463* (2011.01)

(56) References Cited

U.S. PATENT DOCUMENTS 3,199,060 A 8/1965 Marasco
3,827,007 A * 7/1974 Fairbairn ..... H01R 13/28 439/293
3,828,706 A 8/1974 Scott
4,054,350 A 10/1977 Hardesty
4,449,767 A 5/1984 Weidler
4,458,971 A 7/1984 D'Urso et al.
4,565,416 A 1/1986 Rudy et al.
4,702,538 A * 10/1987 Hutter ..... H01R 24/84 439/292
4,743,208 A 5/1988 Weisenburger
4,744,774 A 5/1988 Pauza
4,824,394 A 4/1989 Roath et al.
4,917,625 A 4/1990 Haile
4,932,906 A 6/1990 Kaley et al.
5,013,255 A 5/1991 Juret et al.
5,240,436 A 8/1993 Bradley et al.
5,368,499 A 11/1994 Hirt
5,385,476 A 1/1995 Jasper
5,496,184 A 3/1996 Garrett et al.
5,533,915 A * 7/1996 Deans ..... H01R 13/17 439/678
5,580,264 A 12/1996 Aoyama et al.
5,748,819 A 5/1998 Szentesi et al.
5,749,755 A 5/1998 Genta et al.
5,833,496 A 11/1998 Hollander et al.
5,897,404 A 4/1999 Goodman et al.
5,915,989 A 6/1999 Adriaenssens et al.
5,989,057 A 11/1999 Gerke et al.
6,019,521 A 2/2000 Manning et al.
6,045,389 A 4/2000 Ferrill et al.
6,050,845 A 4/2000 Smalley, Jr. et al.
6,065,994 A 5/2000 Hashim et al.
6,135,804 A 10/2000 Lux
6,217,230 B1 4/2001 Matsushita
6,254,440 B1 7/2001 Ko et al.
6,270,372 B1 8/2001 Jenner et al.
6,280,230 B1 8/2001 Takase et al.
6,390,687 B1 5/2002 Shirakawa
6,402,571 B1 6/2002 Muller et al.
6,488,550 B1 12/2002 Kikuchi et al.
6,499,889 B1 12/2002 Shirakawa et al.
6,568,967 B2 5/2003 Inaba et al.
6,572,276 B1 6/2003 Theis et al.
6,641,431 B2 11/2003 Saitoh
6,690,596 B2 2/2004 Hosono et al.
6,702,617 B1 * 3/2004 Clement ..... H01R 13/6461 439/607.08
7,004,797 B2 2/2006 Harada et al.
7,201,601 B2 4/2007 Lappohn
7,217,162 B2 5/2007 Harada et al.
7,291,046 B2 11/2007 Russelburg
7,325,976 B2 2/2008 Gurreri et al.
7,537,393 B2 5/2009 Anderson et al.
7,559,789 B2 7/2009 Hashim
7,618,297 B2 11/2009 Wang
7,867,033 B2 1/2011 Kumagai et al.
8,052,482 B1 11/2011 Lin
8,109,789 B2 2/2012 Tyler
8,113,889 B2 2/2012 Zhang et al.
8,172,468 B2 5/2012 Jones et al.
8,303,337 B2 11/2012 Ballard et al.
8,684,763 B2 4/2014 Mattson et al.
8,715,016 B2 5/2014 Debock et al.
8,757,895 B2 6/2014 Petersen
8,840,424 B2 9/2014 Kudo
8,915,759 B2 12/2014 Miyamoto
8,979,572 B2 3/2015 Mochizuki
9,093,807 B2 7/2015 O'Connor et al.
9,136,652 B2 * 9/2015 Ngo ..... H01R 13/514
9,172,169 B2 10/2015 Hagio et al.
9,209,578 B2 12/2015 Mochizuki
9,293,877 B2 3/2016 Wong et al.
9,356,439 B2 5/2016 Keith et al.
9,490,591 B2 11/2016 Yamashita et al.
9,590,339 B2 3/2017 Oberski et al.
9,634,417 B2 * 4/2017 Ramanna ..... H01R 13/28
9,685,726 B2 * 6/2017 Ang ..... H01R 13/4223
9,692,161 B2 6/2017 Lindkamp et al.
9,799,981 B2 10/2017 Weber
9,853,388 B2 * 12/2017 Copper ..... H01R 13/44
9,917,390 B1 3/2018 Bianca et al.
9,972,932 B2 5/2018 Copper et al.
10,061,090 B2 8/2018 Coenegracht
10,164,383 B2 * 12/2018 Feng ..... H01R 24/20
10,389,062 B2 8/2019 Zebhauser et al.
10,411,409 B2 9/2019 Hashim et al.
10,665,974 B2 5/2020 Oberski et al.
10,665,985 B2 5/2020 Keith et al.
10,727,626 B2 7/2020 Murray
10,768,374 B2 9/2020 Gurrer et al.
10,998,685 B2 5/2021 Curtis et al.
11,031,719 B2 * 6/2021 Somanathapura Ramanna ..... H01R 24/84
2001/0018287 A1 8/2001 Reichle
2002/0055294 A1 5/2002 Murakami et al.
2002/0072275 A1 6/2002 Arai
2004/0152360 A1 8/2004 Harris et al.
2005/0227545 A1 10/2005 Lahoreau et al.
2005/0232566 A1 10/2005 Rapp et al.
2006/0134966 A1 6/2006 Lappohn
2007/0270043 A1 11/2007 Pepe et al.
2008/0057793 A1 3/2008 Gerber et al.
2009/0176415 A1 7/2009 AbuGhazaleh et al.
2010/0003863 A1 1/2010 Siemon et al.
2010/0035454 A1 2/2010 Morgan et al.
2010/0040332 A1 2/2010 Van Den Meersschaut et al.
2010/0120284 A1 5/2010 Oka et al.
2010/0173528 A1 7/2010 Martich et al.
2010/0221951 A1 9/2010 Pepe et al.
2010/0304600 A1 12/2010 Busse
2011/0294342 A1 12/2011 DeBock et al.
2012/0004655 A1 1/2012 Kim et al.
2013/0075149 A1 3/2013 Golko et al.
2013/0171885 A1 7/2013 Zhang
2013/0252469 A1 9/2013 Mochizuki
2015/0083455 A1 3/2015 Keith et al.
2015/0155670 A1 6/2015 Gardner
2015/0214667 A1 7/2015 Chen et al.
2015/0249295 A1 * 9/2015 Tseng ..... H01R 4/4818 439/668
2016/0028198 A1 1/2016 Yamashita et al.
2016/0131858 A1 5/2016 Anderson et al.
2016/0164223 A1 6/2016 Zebhauser et al.
2016/0315436 A1 10/2016 Plamondon et al.
2017/0005445 A1 1/2017 Resendez et al.
2017/0184798 A1 6/2017 Coenegracht
2017/0207561 A1 7/2017 Scherer et al.
2017/0214186 A1 7/2017 Siev et al.
2017/0264025 A1 9/2017 Lappöhn
2017/0373405 A1 12/2017 Lappoehn
2019/0154923 A1 * 5/2019 Flaig ..... G02B 6/3897
2019/0296491 A1 * 9/2019 Maesoba ..... H01R 13/6474
2020/0106216 A1 4/2020 Hashim et al.
2020/0274273 A1 8/2020 Oberski et al.
2021/0083441 A1 3/2021 Moffitt et al.
2021/0104842 A1 * 4/2021 Keith ..... H01R 31/06

(56) References Cited

U.S. PATENT DOCUMENTS

| | | | | |
|---|---|---|---|---|
| 2021/0104843 | A1* | 4/2021 | Tobey | H01R 13/112 |
| 2021/0151905 | A1* | 5/2021 | Novak | H01R 13/6581 |
| 2021/0194179 | A1 | 6/2021 | Pepe et al. | |

FOREIGN PATENT DOCUMENTS

| | | | |
|---|---|---|---|
| CN | 107104329 | A | 8/2017 |
| CN | 209167592 | U | 7/2019 |
| DE | 102 16 915 | A1 | 10/2003 |
| EP | 1 128 494 | A2 | 8/2001 |
| EP | 1 783 871 | A1 | 5/2007 |
| FR | 2 290 136 | A7 | 5/1976 |
| GB | 628 419 | A | 8/1949 |
| GB | 2510490 | A8 | 8/2014 |
| JP | 4514356 | B2 | 5/2010 |
| KR | 10-2010-0122766 | A | 11/2010 |
| WO | 2006/048867 | A1 | 5/2006 |
| WO | 2016/132855 | A1 | 8/2016 |
| WO | 2017/019370 | A1 | 2/2017 |
| WO | 2019/165466 | A1 | 8/2019 |
| WO | 2020/051340 | A1 | 3/2020 |

OTHER PUBLICATIONS

DiBiaso et al., "Designing a Connection System for Gigabit Automotive Ethernet," SAE International Journal of Passenger Cars—Electronic and Electrical Systems, vol. 9, No. 1, pp. 134-146 (May 2016).

2-Pin Connector w/Header, .10, All Electronics Corporation, 3 pages, downloaded: http://www.allelctronics.com/item/con-242/2-pin-connector-w/header-.10/html (May 31, 2017).

2 Pin Connectors, Wiring Specialties, 5 pages (May 31, 2017).

International Search Report and Written Opinion of the International Searching Authority for International Patent Application No. PCT/US2019/014906 dated May 14, 2019, 12 pages.

U.S. Non-Final Office Action for U.S. Appl. No. 16/975,891 dated Aug. 25, 2021.

U.S. Final Office Action for U.S. Appl. No. 16/608,126 dated Sep. 1, 2021.

U.S. Non-Final Office Action for U.S. Appl. No. 15/931,046 dated Jul. 19, 2021.

U.S. Non-Final Office Action for U.S. Appl. No. 16/081,595 dated Jul. 21, 2021.

Office Action from Chinese Application No. 201980023438.2 dated Jun. 3, 2021, 19 pages [English translation].

Notice of Allowance for U.S. Appl. No. 16/620,185 dated Nov. 8, 2021.

U.S. Non-Final Office Action for U.S. Appl. No. 16/608,126 dated Dec. 29, 2021.

U.S. Final Office Action for U.S. Appl. No. 15/931,046 dated Jan. 19, 2022.

* cited by examiner

CONNECTORS FOR A SINGLE TWISTED PAIR OF CONDUCTORS

CROSS-REFERENCE TO RELATED APPLICATION

This application is a National Stage Application of PCT/US2019/014906, filed on Jan. 24, 2019, which claims the benefit of U.S. Patent Application Ser. No. 62/622,562, filed on Jan. 26, 2018, the disclosures of which are incorporated herein by reference in their entireties. To the extent appropriate, a claim of priority is made to each of the above disclosed applications.

TECHNICAL FIELD

The present disclosure is directed to connectors and, more specifically, to connectors for use with a single-twisted pair of conductors.

BACKGROUND

A single twisted pair of conductors can be used to transmit data and/or power over a communications network that includes, for example, computers, servers, cameras, televisions, and other electronic devices including those on the internet of things (IoT), etc. In the past, this has been performed through use of Ethernet cables and connectors which typically include four pairs of conductors that are used to transmit four differential signals. Differential signaling techniques, where each signal is transmitted over a balanced pair of conductors, are used because differential signals may be impacted less by external noise sources and internal noises sources, such as crosstalk, as compared to signals that are transmitted over unbalanced conductors. In Ethernet cables, the insulated conductors of each differential pair are tightly twisted about each other to form four twisted pairs of conductors, and these four twisted pairs may be further twisted about each other in a so-called "core twist." A separator may be provided that is used to separate at least one of the twisted pairs from at least one other of the twisted pairs. The four twisted pairs and any separator may be enclosed in a protective jacket. Ethernet cables are connectorized with Ethernet connectors; a single Ethernet connector is configured to accommodate all four twisted pairs of conductors. However, it is possible that data and/or power transfer can be effectively supported through a singled twisted pair of conductors with its own more compact connector and cable. Accordingly, a connector design different from a standard Ethernet connector is needed.

SUMMARY

A family of connectors to accommodate a single twisted pair of conductors is disclosed herein. The family of connectors includes a plug, receptacle and adapter with the plug incorporating beam contacts, and the receptacle and adapter incorporating interfacing arched beam contacts. A z-configuration of the port(s) within the receptacle and adapter is configured to interface with the plug, which also presents a z-configuration. The parallel, upper and lower portions of the z-configuration of the plug incorporate the beam contacts. The first beam contact of the plug is rotated 180 degrees from the second beam contact of the plug; the arched beam contacts are similarly rotated. The plug, receptacle and adapter of a small form factor that is similar or identical to the formal factor of an optical fiber LC connector. The plug and receptacle can be configured for circuit board, cable or patch cord mounting.

An aspect of the present disclosure is directed to a connector for a single twisted pair of conductors. The connector includes a plug housing, a first beam contact and a second beam contact. The plug housing presents a forward face having a z-configuration that includes a first portion offset from a second portion; the first and second portion connected by a central portion. The first beam contact is mounted within the plug housing and has an exposed portion proximate the first portion of the forward face of the plug. Similarly, the second beam contact is mounted within the plug housing and has an exposed portion proximate the second portion of the forward face of the plug. The first beam contact has an opposite orientation to the second beam contact, e.g. the first beam contact is rotated 180 degrees relative to the second beam contact. The first and second beam contacts are electrically coupled to a single twisted pair of conductors.

Another aspect of the present disclosure is directed to another connection for a single twisted pair of conductors. This connection includes a receptacle housing, a first arched beam contact, and a second arched beam contact. The receptacle housing presents a forward face defining a port having a z-configuration, e.g. the port includes a first portion offset from a second parallel portion with the first and second portions connected by a central portion. The first arched beam contact is enclosed within the receptacle housing and is positioned proximate the first portion of the forward face of the receptacle. Similarly, the second arched beam contact is enclosed within the receptacle housing and is positioned proximate the second portion of the forward face of the receptacle. The first arched beam contact has an opposite orientation to the second arched beam contact, e.g. the first arched beam contact is rotated 180 degrees relative to the second arched beam contact. The first and second arched beam contacts are electrically coupled to a circuit board or to first and second conductors of a single twisted pair of conductors.

Another aspect of the present disclosure is directed to an adapter for coupling two single twisted pairs of conductors. The adapter includes a body portion that has first and second ports. Each of the first and second ports includes first and second arched beam contacts that are accessible via the ports. Each of the first and second ports is configured to interface with a two-contact only connector such as the plug connector described herein.

Still another aspect of the present disclosure is directed to a patch cord. The patch cord includes a cable having a single twisted pair of conductors with each of the conductors having a first end and a second end. The first ends of the twisted pair are electrically coupled to one of the plug or receptacle described herein while the second ends of the are similarly electrically coupled to one of the plug or receptacle described herein.

Still another aspect of the present disclosure is directed to a system that includes one or more of the plugs described herein and an equal number of one or more receptacles described herein. Each plug is configured to interface both mechanically and electrically with a corresponding receptacle.

DETAILED DESCRIPTION

A family of connectors to accommodate a single twisted pair of conductors is disclosed herein. The family of connectors includes a plug, a receptacle, and an adapter; the plug and/or receptacles can be modified to accommodate various wiring, patch cord and mounting configurations. The connectors have a small form factor, such as an optical fiber LC connector format factor. The receptacle and adapter utilize a pair of arched beam contacts that are configured to interface with the pair of beam contacts of the plug. The plug and receptacle can be utilized in a single plug/single receptacle configuration or in a multi-plug/multi-receptacle configuration. The interfacing pair of arched beam contacts and beam contacts are maintained in an offset, noise-cancelling, orientation due to z-shaped port in the receptacle and a corresponding z-shaped plug.

Figure 1:
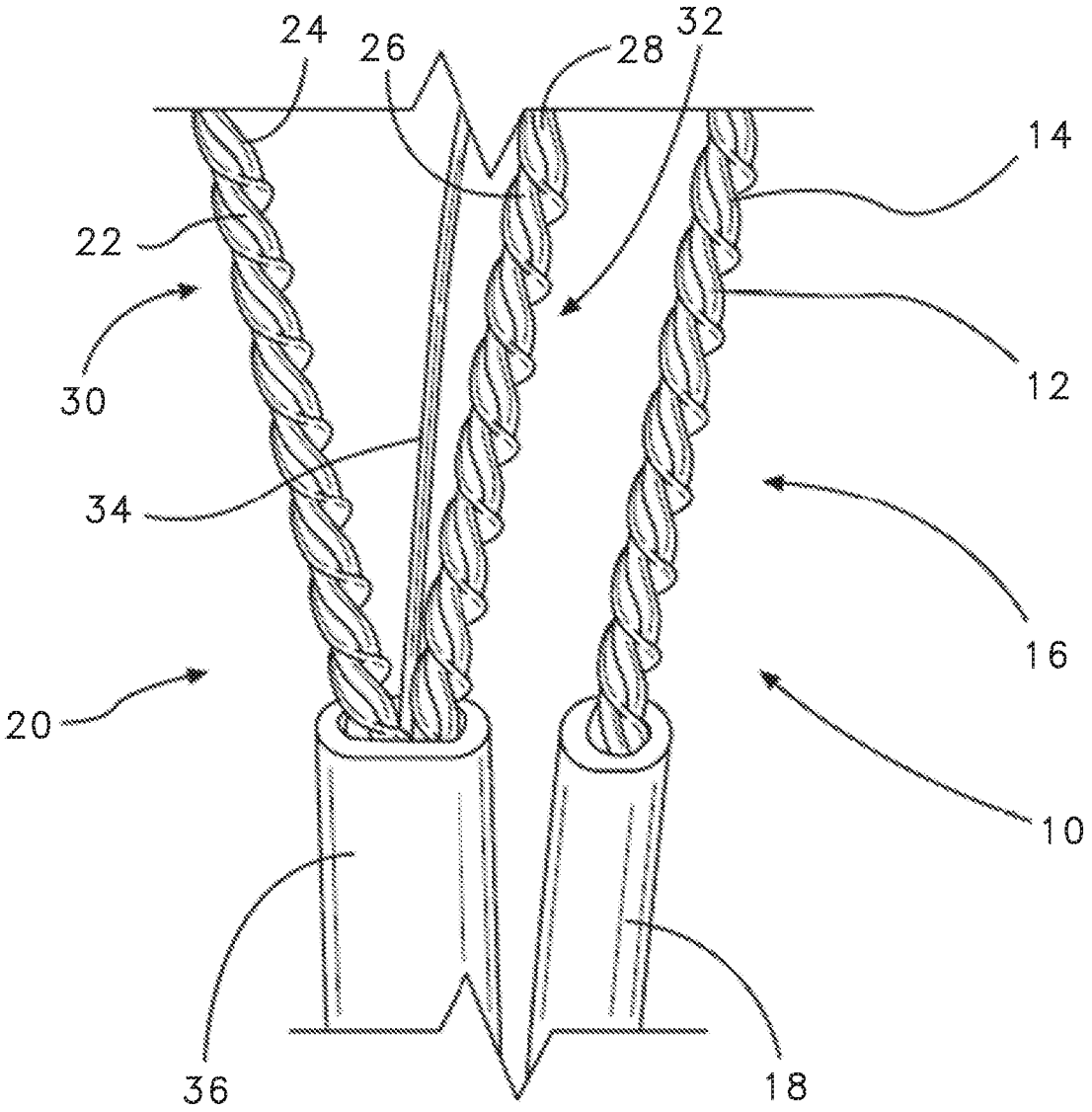
FIG. 1 illustrates example embodiments of cables having single twisted pairs of conductors.

FIG. 1 illustrates two example embodiments of cables containing one or more single twisted pairs of conductors. The first cable 10 includes first and second conductors 12, 14 that are twisted together to form a single twisted pair 16. The conductors 12, 14 are enclosed by a protective jacket 18. The second cable 20 includes first through fourth conductors 22, 24, 26, 28. Conductors 22 and 24 are twisted together to form a first single twisted pair 30, and conductors 26 and 28 are twisted together to form a second single twisted pair 32. The twisted pairs 30 and 32 are separated by a separator 34, and are encased in a protective jacket 36. In certain example embodiments, the cables 10, 20 include a number of twisted pairs greater than two. In certain example embodiments, each single twisted pair of conductors, e.g., 16, 30, 32, is configured for data transmission up to 600 MHz and has a current carrying capacity up to 1 A. Each single twisted pair of conductors, e.g., 16, 30, 32, can be connectorized with the various embodiments or combination of embodiments of plugs and receptacles as described herein. The connectorized twisted pairs can be coupled with an adapter as described herein.

Figure 2:
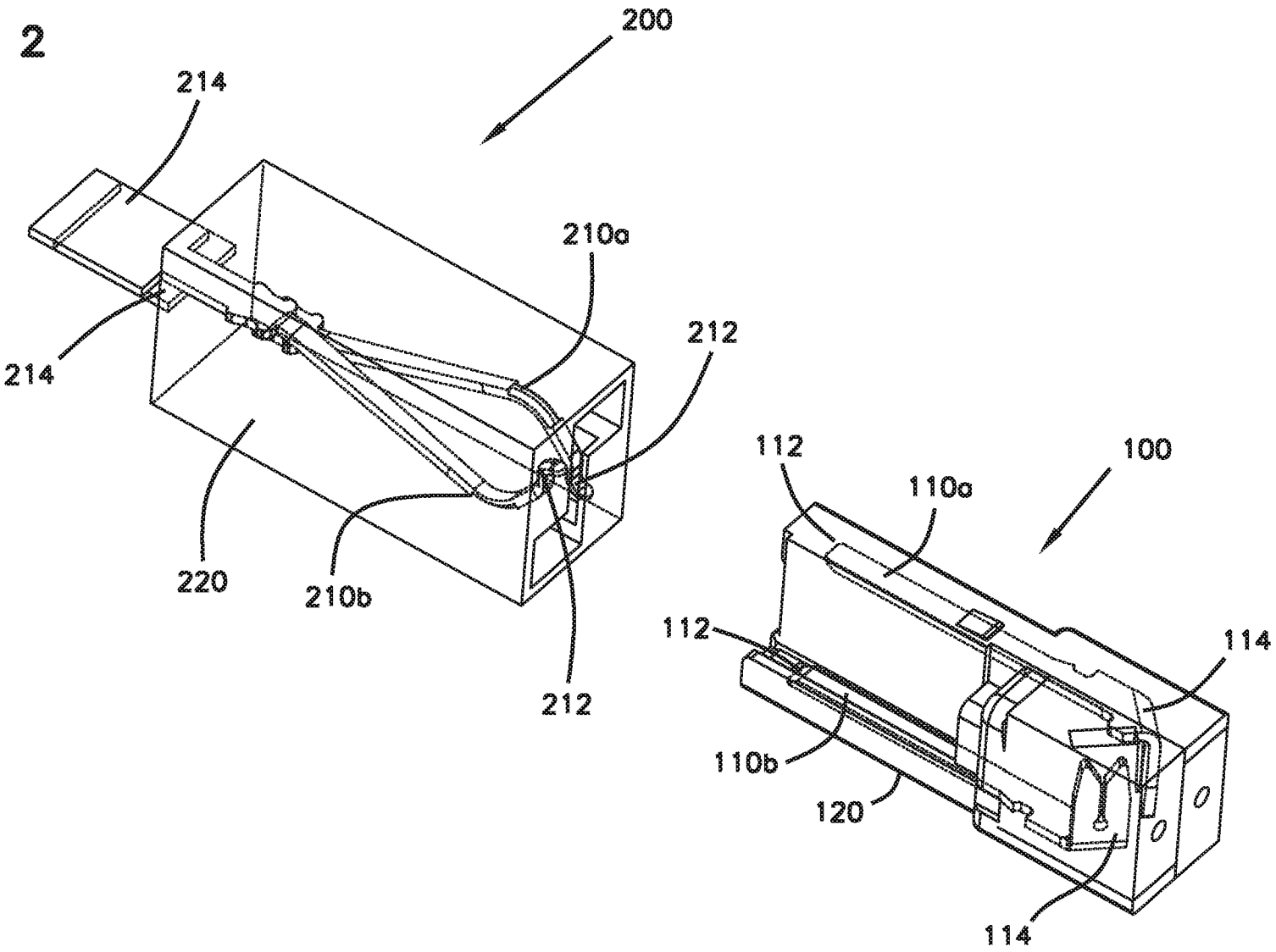
FIG. 2 is a transparent perspective view of a plug and receptacle for single twisted pair of conductors according to the present disclosure.
Figure 3:
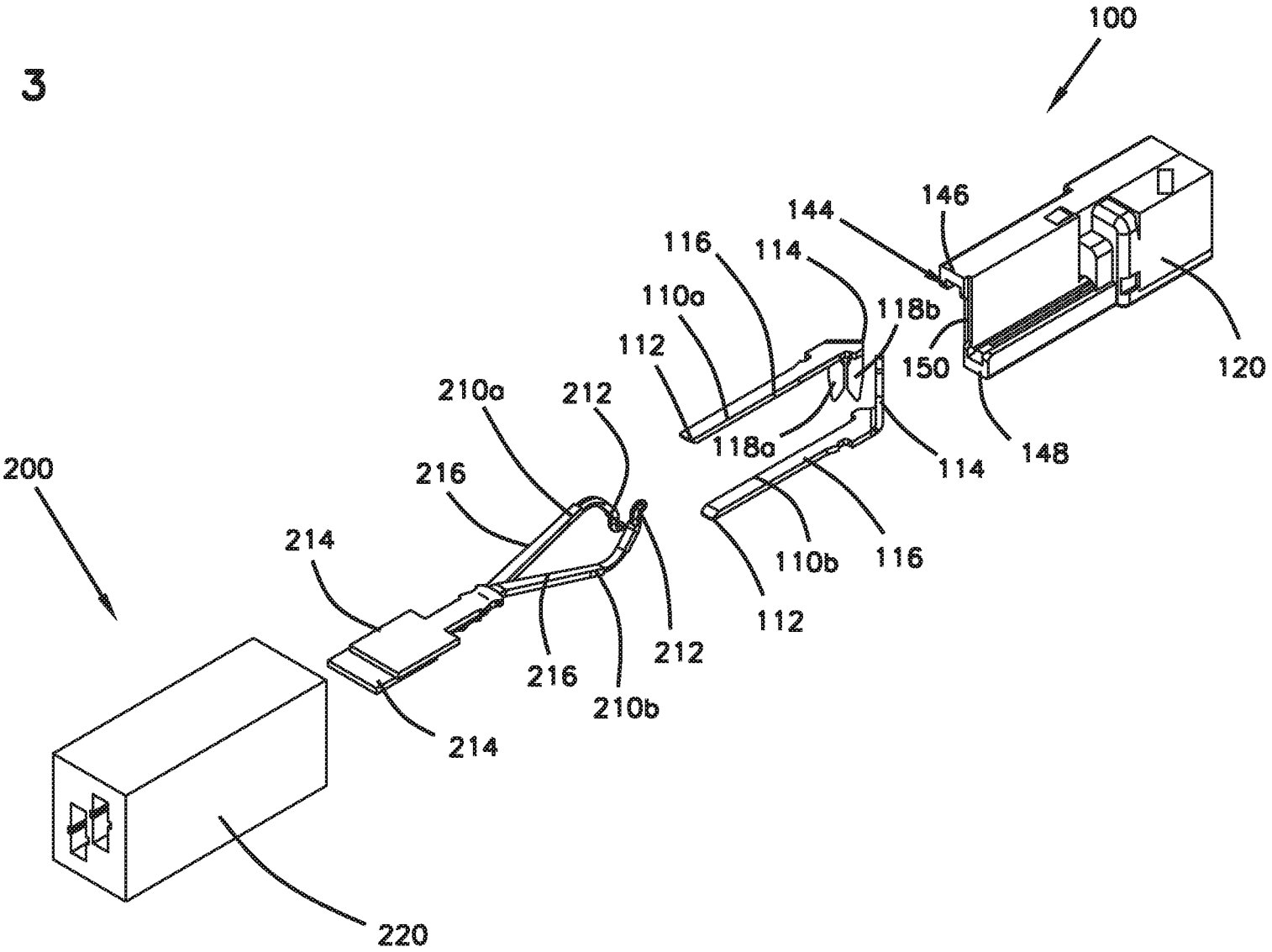
FIG. 3 is an exploded perspective view of the plug and receptacle of the present disclosure.
Figure 4:
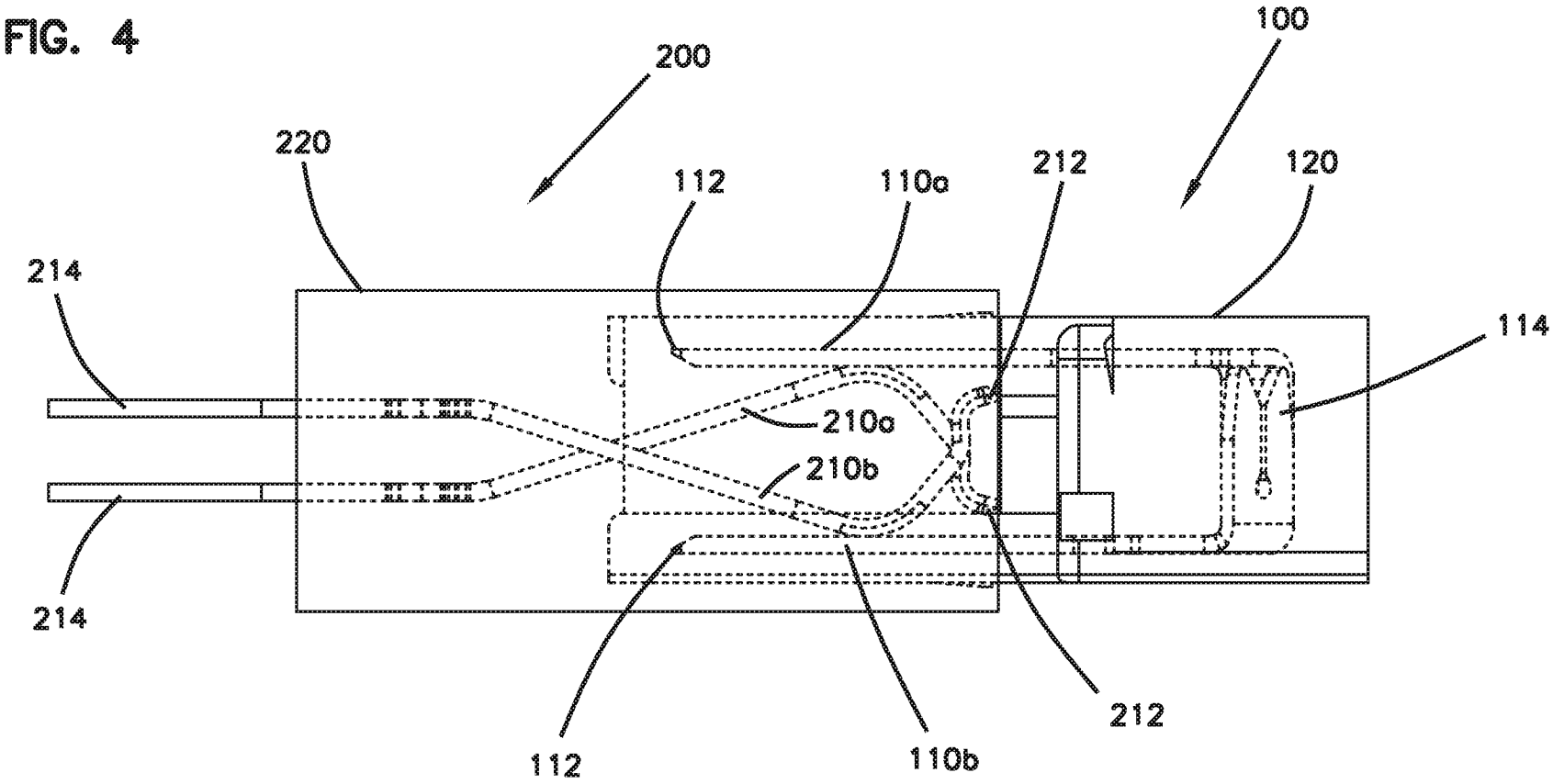
FIG. 4 is a transparent side view of the plug and receptacle of the present disclosure wherein the plug is received within the receptacle.

Referring to FIGS. 2-4 an example of the plug 100 and the receptacle 200 of the present disclosure can be appreciated. In certain embodiments, each of the plug 100 and the receptacle 200 include a single pair of contacts with the plug 100 including a pair of beam contacts 110*a*, 110*b* and the receptacle 200 including a pair of arched beam contacts 210*a*, 210*b*. Further, each of the plug 100 and the receptacle 200 include a housing, e.g. housing 120 and housing 220, respectively. When the housing 120 of the plug 100 is received within the housing 220 of the receptacle 200, electrical coupling of beam contacts 110*a*, 110*b* with arched beam contacts 210*a*, 210*b* occurs.

Each of beam contacts 110*a*, 110*b* includes a forward end 112, a rearward end 114, and an elongate central portion 116 connecting the forward end 112 and the rearward end 114. Each rearward end 114 includes a pair of tines 118*a*, 118*b* that can be an insulation piercing contact (IPC), as depicted in FIG. 3, or that can be formed to implement a crimped, fused, welded or otherwise electrically coupled contact to one conductor, e.g. conductor 12 or 14, of a single twisted pair cable. In certain embodiments, the rearward end 114 can be configured for electrical coupling to a printed circuit board (PCB) or other electrical device.

Each of arched beam contacts 210*a*, 210*b* includes a forward end 212, a rearward end 214 and an arched central portion 216 connecting the forward end 212 and rearward end 214. Each rearward end 214 can be crimped, fused, welded or otherwise electrically coupled to a printed circuit board (PCB) or other electrical device. In certain embodiments, the rearward end 214 of each of the arched beam contacts 210*a*, 210*b* can be configured for electrical coupling with a conductor, e.g. conductor 12 or 14, of a single twisted pair cable.

As seen in FIG. 4 the arched beam contacts 210*a* and 210*b* cross over each other between their mating interfaces with the plug beam contacts 110*a* and 110*b* and their rearward end 214. This presence of this crossover minimizes the coupling of common-mode noise into the contacts of a proximate adjacent connector when a differential signal is transmitted on the contacts of the connector 200.

Figure 5A:
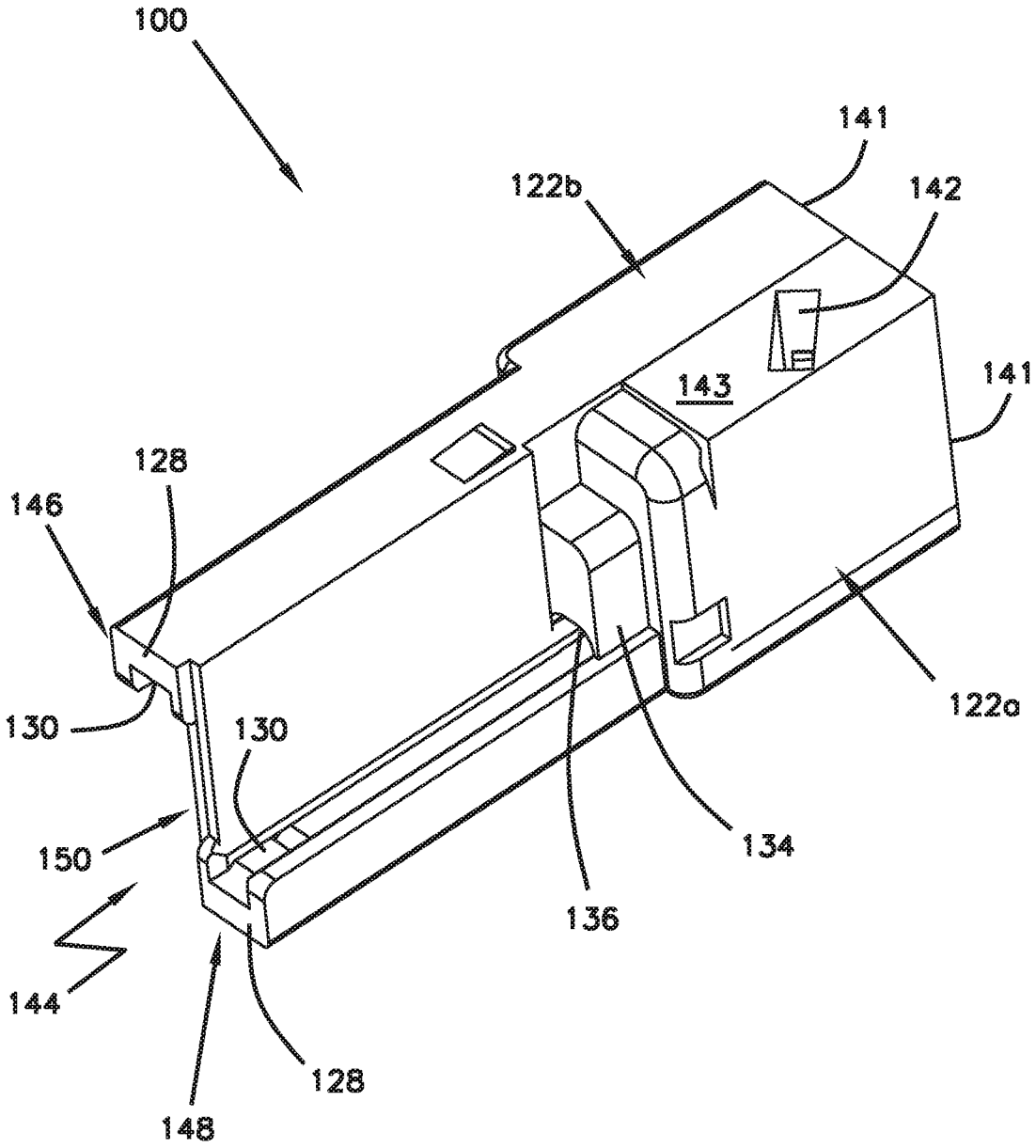
FIGS. 5A-5C are a forward perspective view of the plug of the present disclosure, a first side perspective view of a component of the plug and a second side perspective view of the component of the plug and a rear view of the first side, respectively.
Figure 5B:
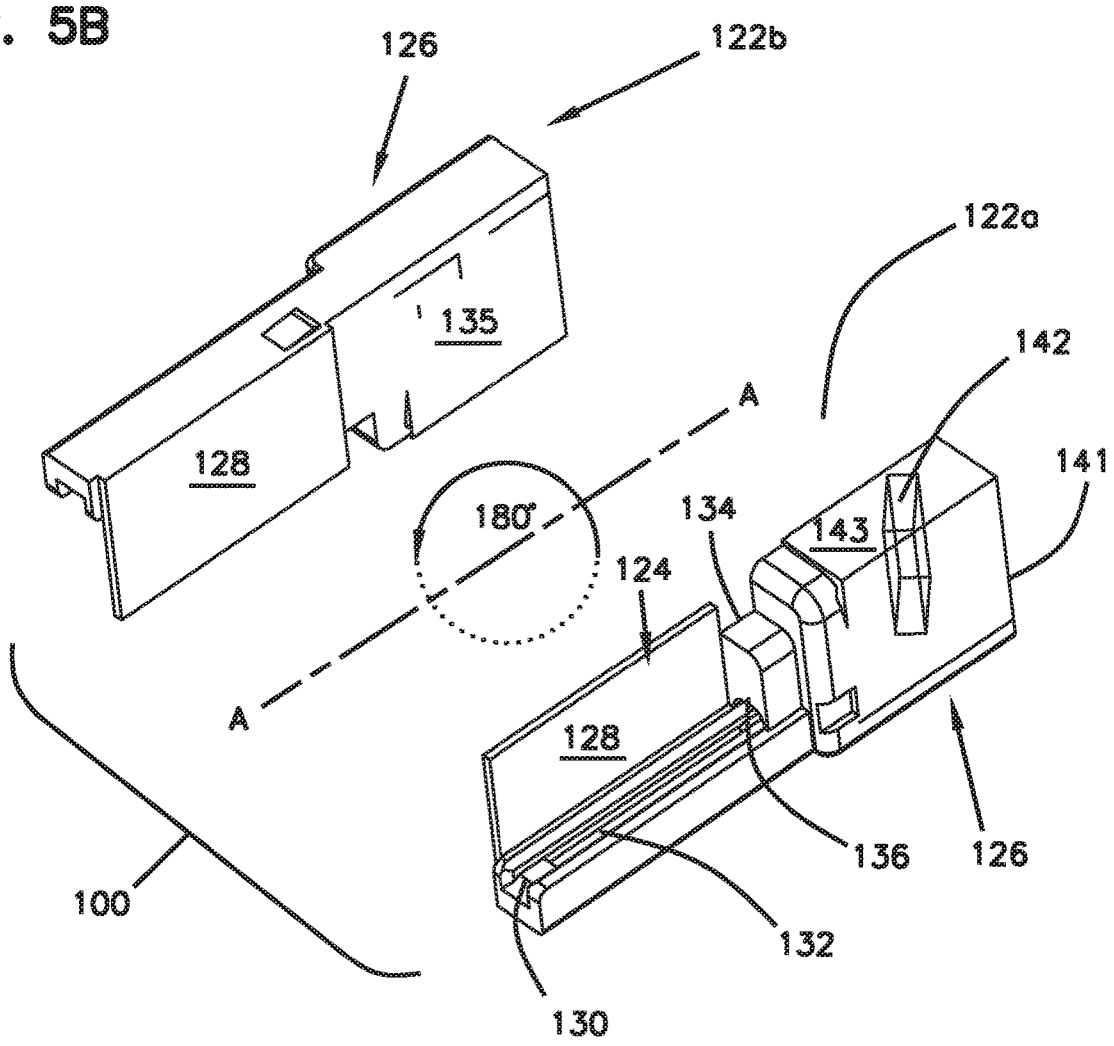
Figure 5C:
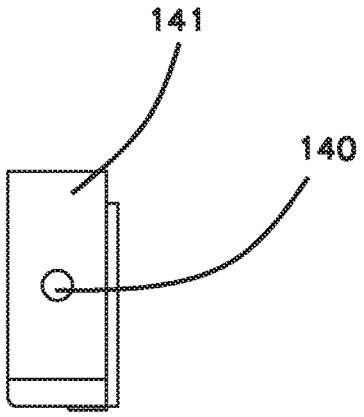
Figure 6A:
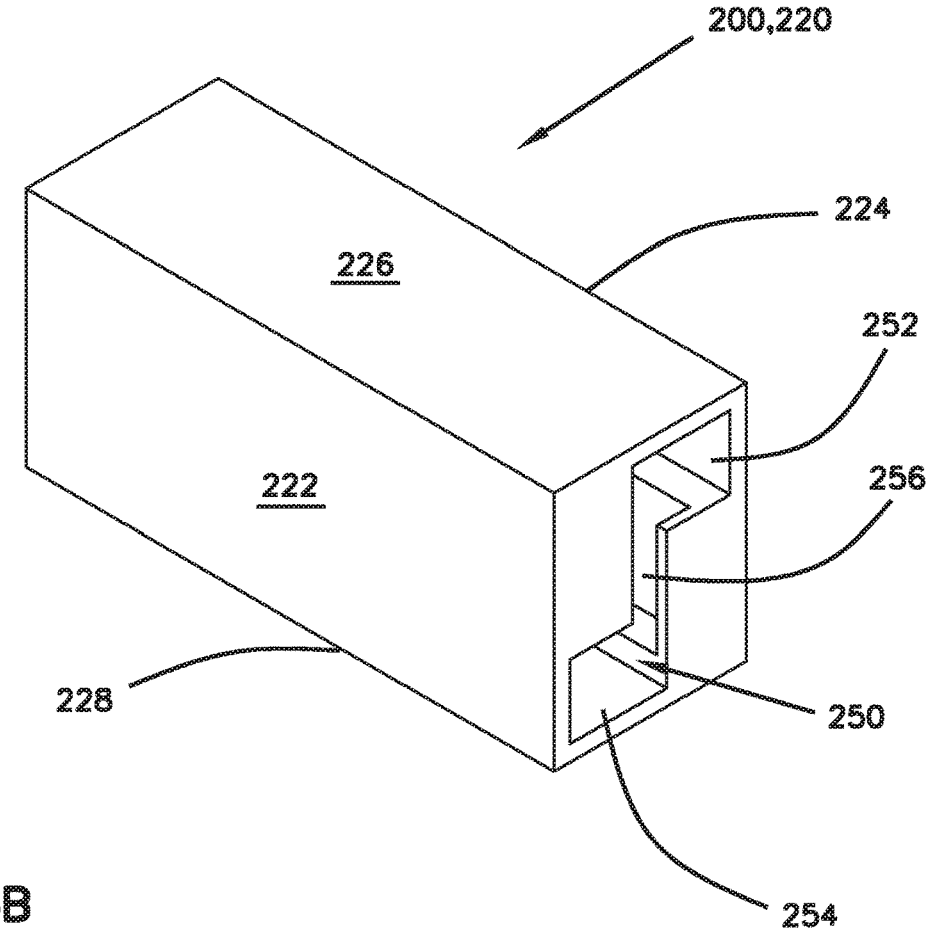
FIGS. 6A-6B are forward and rearward perspective views, respectively, of the receptacle of the present disclosure
Figure 6B:
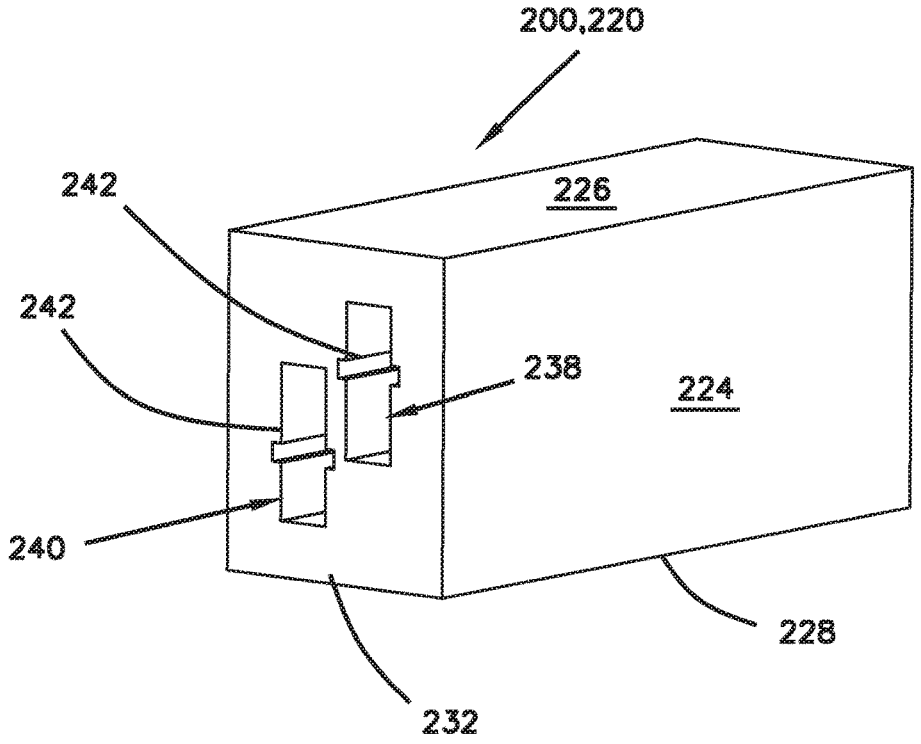
Figure 6C:
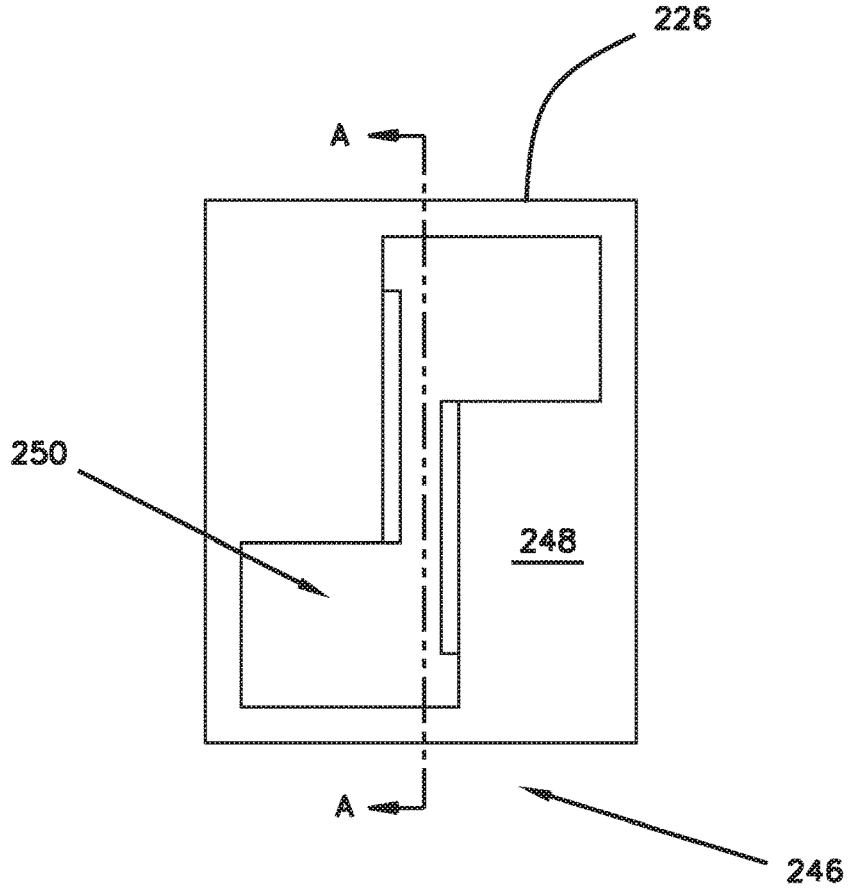
FIG. 6C is a forward view of the receptacle of the present disclosure
Figure 6D:
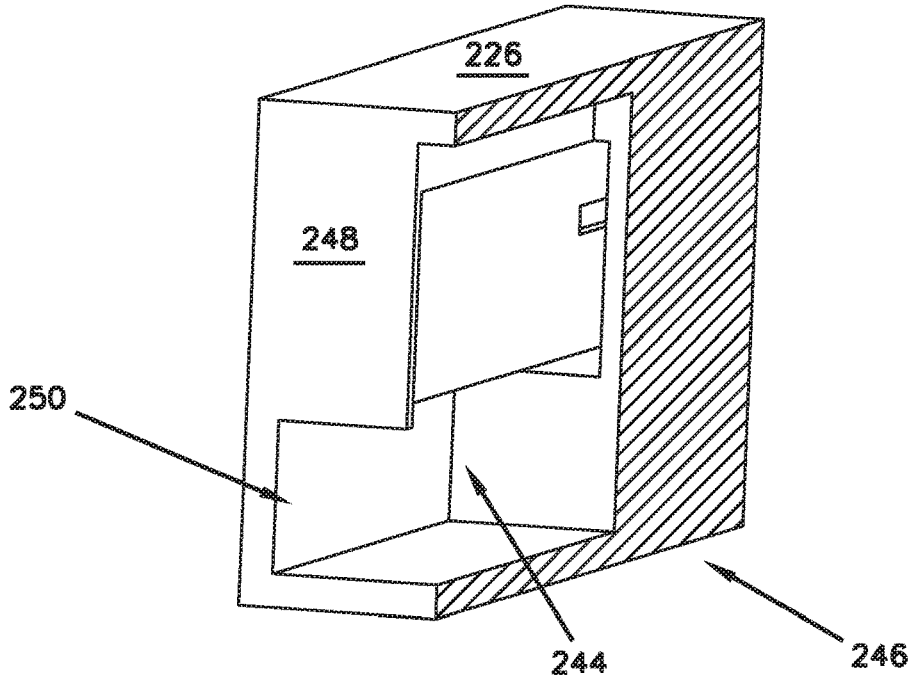
FIG. 6D is a cross-sectional view of the receptacle taken along line A-A of FIG. 6C.
Figure 6E:
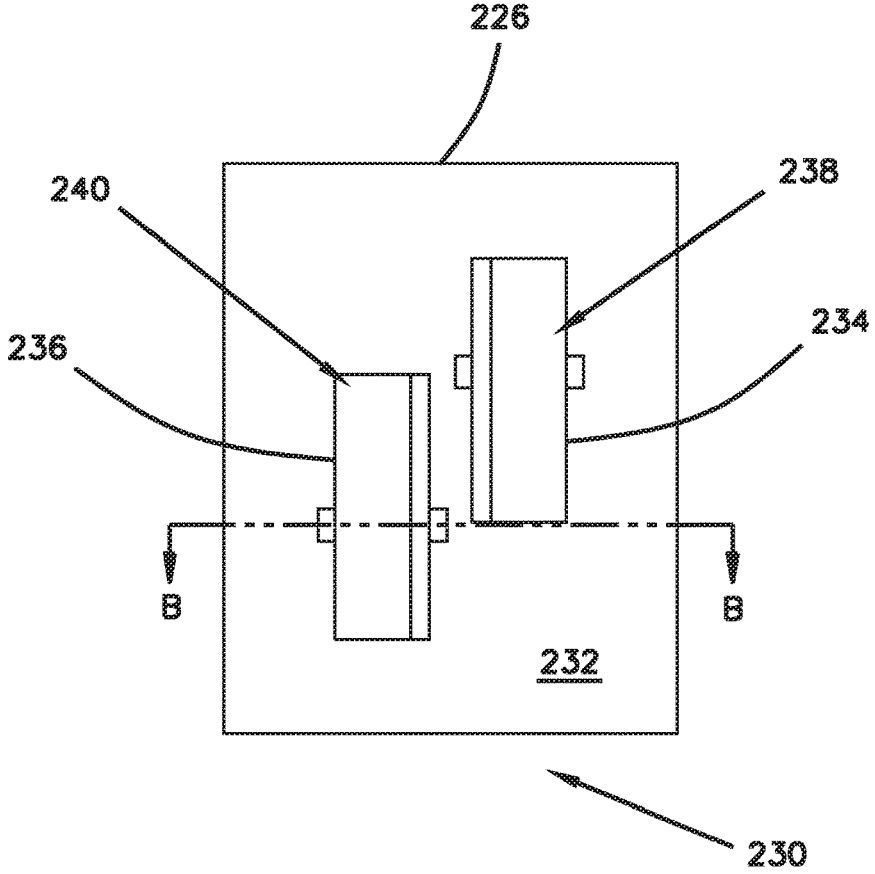
FIG. 6E is a rearward view of the receptacle of the present disclosure.
Figure 6F:
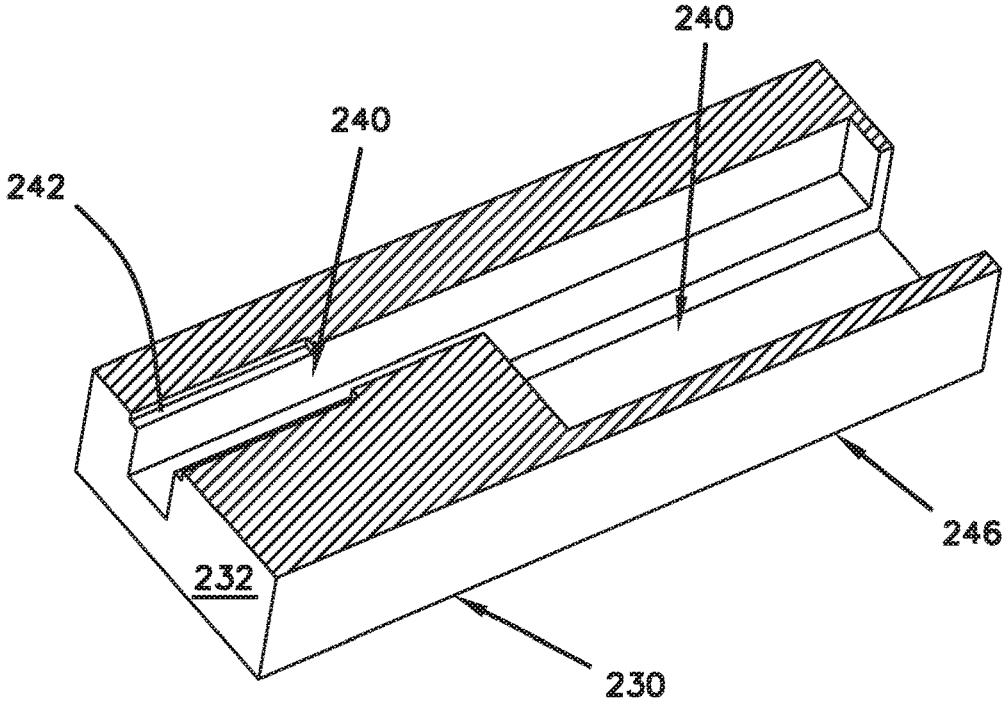
FIG. 6F is a cross-sectional view of the receptacle taken along line B-B of FIG. 6E.
Figure 7A:
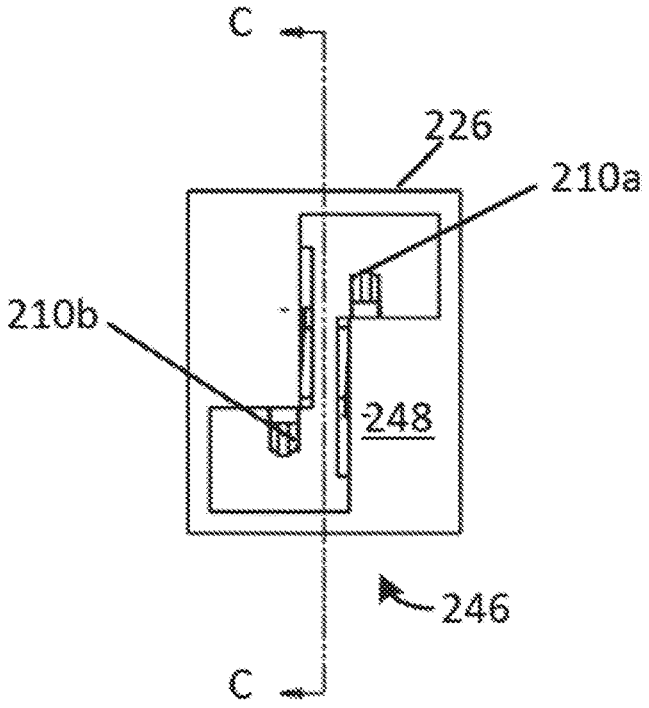
FIG. 7A is a front view of the receptacle of the present disclosure illustrating a pair of contacts within.
Figure 7B:
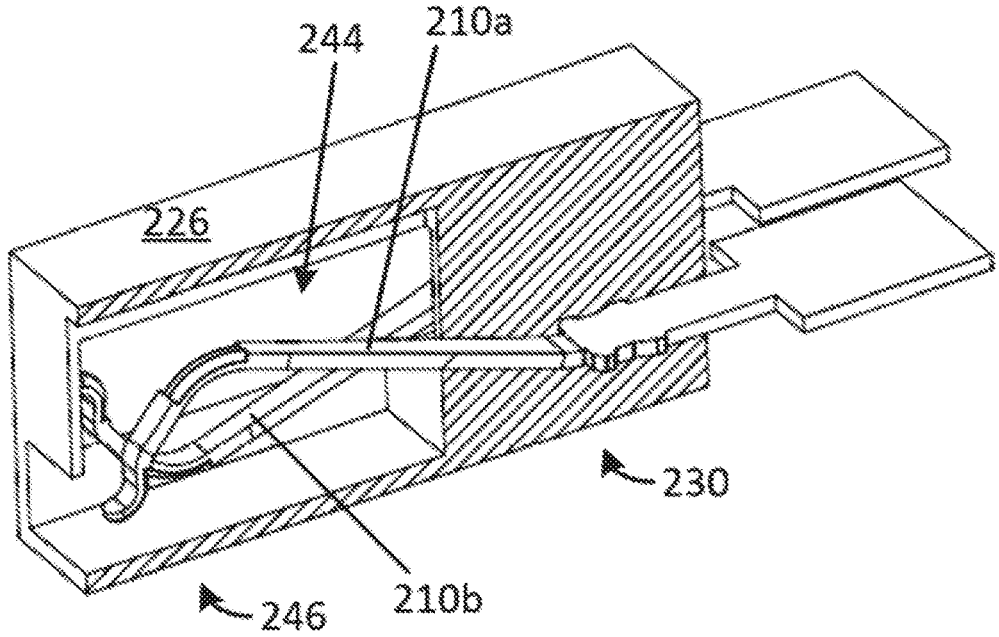
FIG. 7B is a cross-sectional perspective of the receptacle taken along line C-C of FIG. 6A.

FIGS. 5A-5C illustrate an example embodiment of the housing 120 of the plug 100. In certain embodiments, the housing 120 comprises a unitary component having a first side 122*a* and a second side 122*b*; the second side 122*b* is essentially the first side 122*a* rotated 180 degrees about an axis A. In certain embodiments, the housing 120 comprises a plurality of components, for example, wherein the first side 122*a* is an individual component coupled to an individual component comprising the second side 122*b*, which is a 180-degree reflection of the first side 122*a*. In certain embodiments, the beam contacts 110*a*, 110*b* (see FIGS. 2-4) are integrated to the housing 120 by molding the housing over the beam contacts 110*a*, 110*b* while in other examples the beam contacts 110*a*, 110*b* are added to the housing 120 after fabrication of the housing 120.

The first side 122*a* of the housing 120 includes an open forward portion 124 and a rear portion 126 that is substantially enclosed. The open forward portion includes a vertical sidewall 128 that stands perpendicular to an elongate trough 130 that defines a channel 132 for placement of the forward end 112 and at least part of elongate central portion 116 of the beam contact 110*b*. The rear portion 126 includes a stop block 134 and a compartment housing 135 positioned rear of the stop block 134. The stop block 134 prevents over-insertion of the plug 100 within the receptacle 200; a slot 136 below the stop block 134 enables the central portion 116 of the beam contact 110*b* to pass underneath the stop block 134 and into an open compartment 138 of the compartment housing 135.

The compartment housing 135 is configured to accommodate the rearward end 114 of the beam contact 110*b*. A first opening 140 in a rear face 141 of the compartment housing 135 enables insertion of an insulated conductor, e.g. conductor 12 or 14 of FIG. 1, into the compartment housing 135 and through to the rearward end 114 of the beam contact 110*b*. A second opening 142 in a side face 143 enables the insertion of a tool to press the inserted insulated conductor between the tines 118*a*, 118*b* thus enabling them to cut through the insulation and contact the conductor; other methods of electrically coupled the beam contact 110*b* to the conductor or circuit board can also and/or additionally be used. The second side 122*b* of the housing 120 includes the same elements as the first side 122*a* albeit rotated 180 degrees. Together, the sides 122*a*, 122*b* provide the plug 100 with a forward face 144 having a z-configuration including a first portion 146 and a second portion 148 connected by a central portion 150, see FIGS. 3 and 5A, with the upper beam contact 110*a* and the lower beam contact 110*b* in an offset orientation.

FIGS. 6A-6F and 7A-7B illustrate an example embodiment of the housing 220 of the receptacle 200. As shown, the housing 220 generally comprises an elongate body having first and second sides 222, 224 respectively, connected by third and fourth sides, 226, 228, respectively. A rear portion 230 of the housing 220 includes a rear face 232 having offset first and second openings 234, 236, respectively. The first and second openings 234, 236 are the openings to respective first and second channels 238, 240. Each of the first and second channels 238. 240 include a pair of guide edges 242 to assist in the offset placement of the rearward ends 214 of each of the arched beam contacts 210*a*, 210*b*. The first and second channels 238, 240 extend forward to a single port 244 in a forward portion 246 of the housing 220; the single port 244 is configured to accommodate and contain the arched central portion 216 and the forward end 212 of each of the arched beam contacts 210*a*, 210*b*.

The forward portion 246 of the housing 220 further includes a forward face 248 defining an opening 250, which has a z-configuration, to the port 244 that accommodates the offset, z-configuration of the plug 100. The z-configuration opening 250 of the forward face 248 includes a first portion 252 and a second portion 254 connected by a central portion 256 (see FIG. 6A) The configuration of the receptacle 200 enables the rearward end 214 of each of the arched beam contacts 210*a*, 210*b* to be electrically coupled to a printed circuit board. In certain examples, the configuration of the receptacle 200 and the arched beam contacts 210*a*, 210*b* can be modified for electrical coupling with a conductor, e.g., conductor 12 or 14, of a single twisted pair cable.

Upon insertion of the plug 100 within the receptacle 200, the beam contact 110*a* of the plug 100 is placed in contact with, and electrically coupled to, the arched beam contact 210*a* of the receptacle 200. Similarly, the beam contact 110*b* of the plug 100 is placed in contact with, and electrically coupled to, the arched beam contact 210*b* of the receptacle 200. The vertical sidewall 128 of the plug 100 helps to keep the two pairs of electrically coupled contacts separate. Further, the offset, z-configuration of the two pairs of electrically coupled contacts helps to neutralize cross-talk between the pairs of contacts of proximate adjacent connectors. A tension fit helps to maintain the inserted plug 100 within the receptacle 200. The spring-like action of the arched beam contacts 210*a*, 210*b* helps to maintain contact with the beam contacts 110*a*, 110*b* and also helps to retain the plug 100 within the receptacle 200.

Figure 8A:
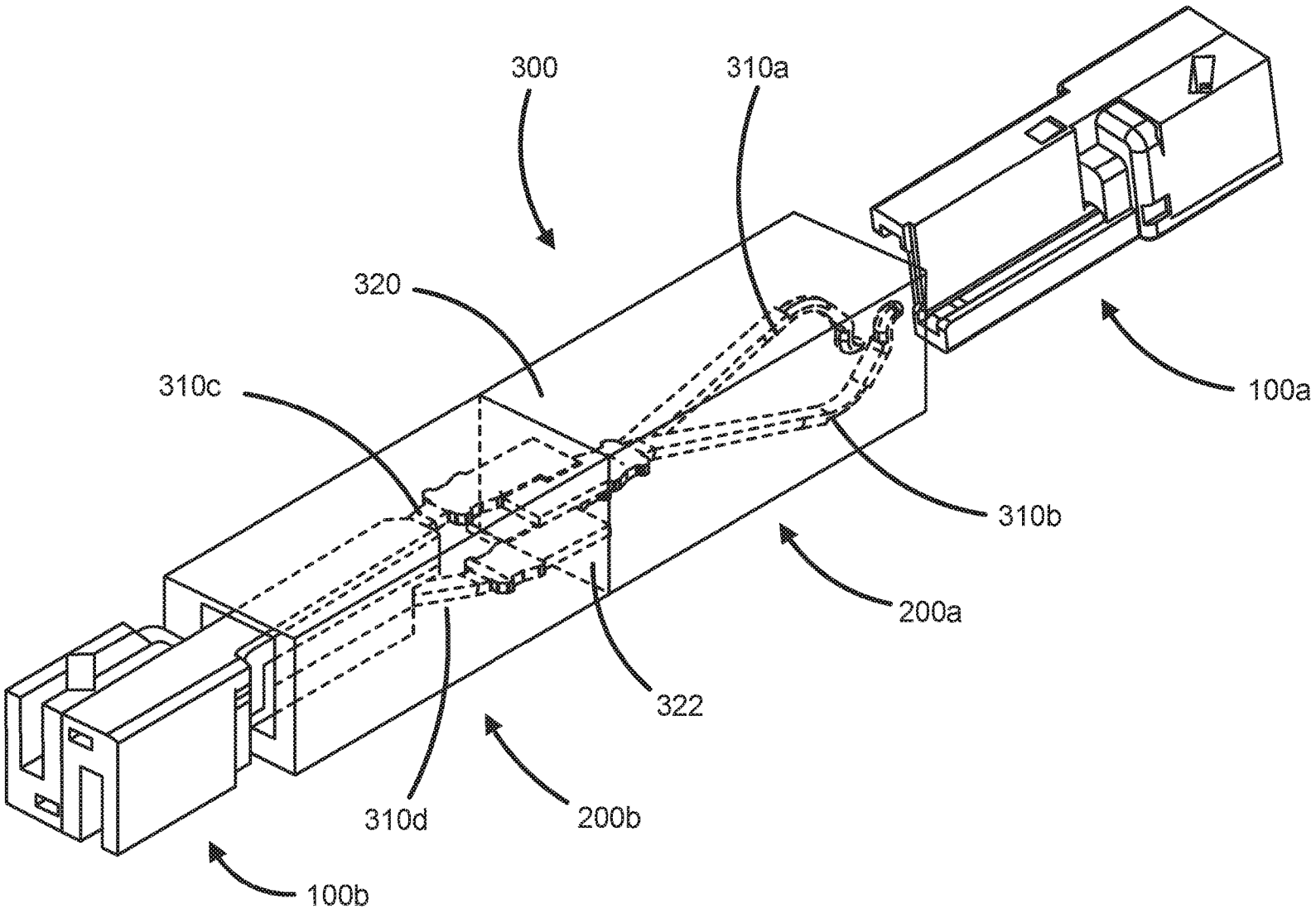
FIGS. 8A-8B are a perspective view of an adapter according to the present disclosure with respect to two plugs and a corresponding perspective view of the contacts of the adapter and plugs, respectively.
Figure 8B:
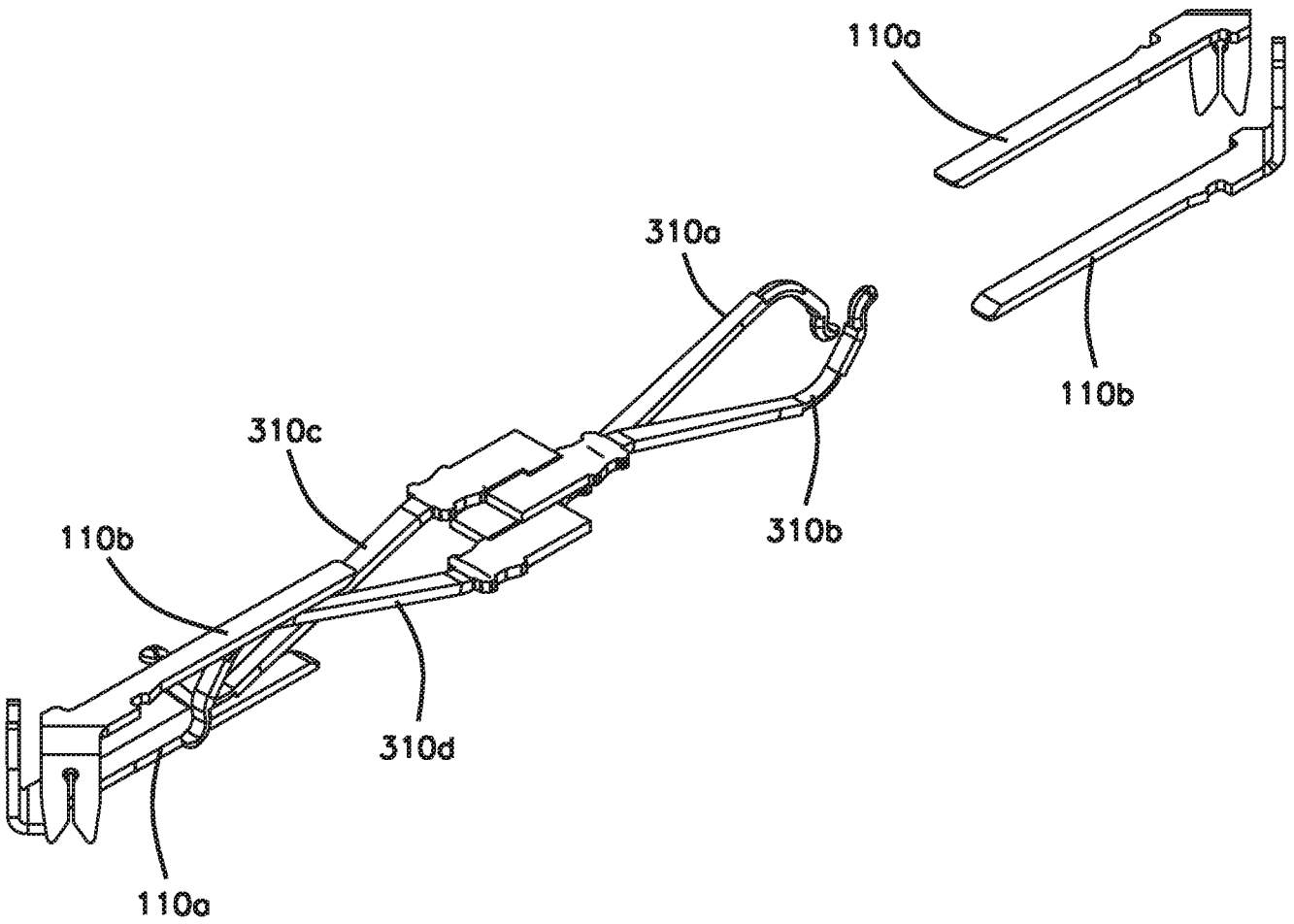

FIGS. 8A-8B illustrate an example embodiment of an adapter 300 according to the present disclosure. The adapter 300 essentially comprises two receptacles 200 within a single housing 320 that share a common central wall 322. The central wall 322 accommodates and appropriately positions two pairs of arched beam contacts 310*a*-310*b* and 310*c*-310*d*. Arched beam contacts 310*a*-310*b* are electrically coupled to arched beam contacts 310*c*-310*d* to maintain the desired electrical polarity. Further, arched beam contacts 310*a*, 310*b* configured to interface with beam contacts 110*a*, 110*b* of plug 100*a* while arched beam contacts 310*c*, 310*d* are configured to interface with beam contacts 110*a*, 110*b* of plug 100*b*.

Figure 9A:
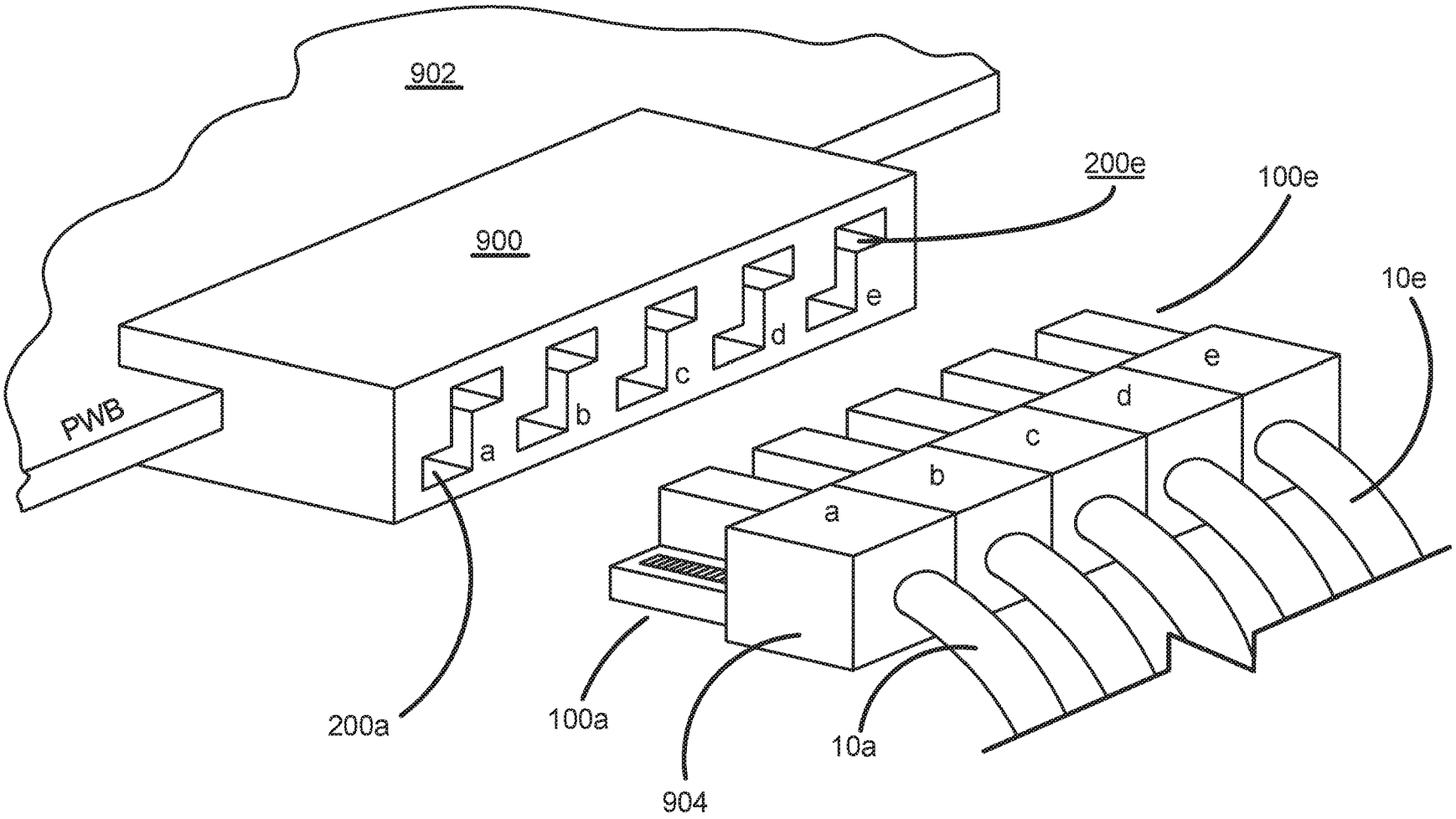
FIGS. 9A-9B are perspective views of first and second examples, respectively, of multi-receptacle/multi-plug configurations according to the present disclosure.
Figure 9B:
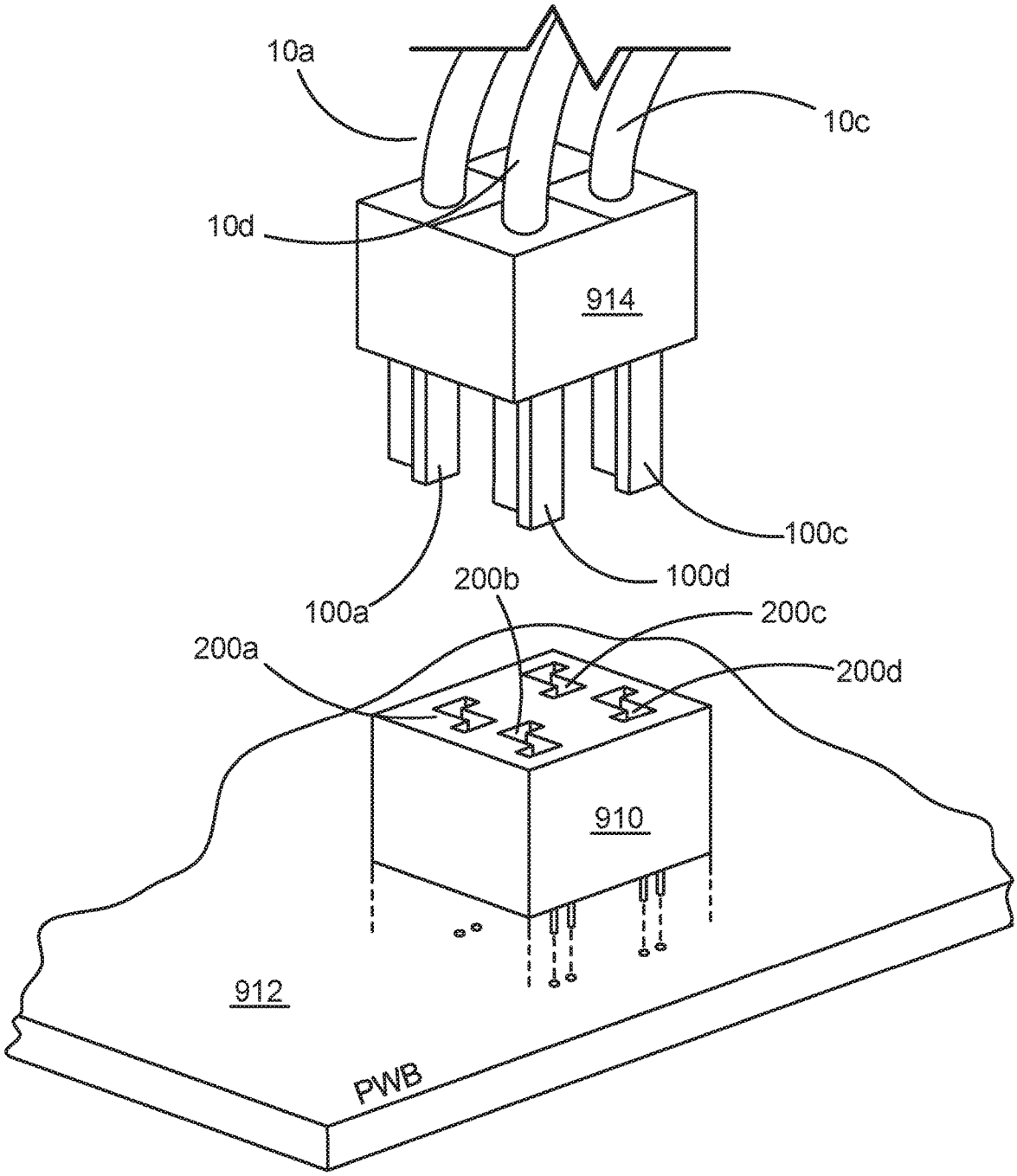

FIGS. 9A-9B illustrate multi-plug and/or multi-receptacle configurations of the plug 100 and receptacle 200. For example, FIG. 9A illustrates a multi-receptacle housing 900 mounted to a printed wiring board (PWB) 902, or any other suitable circuit board, having five receptacles 200*a*-200*e* positioned linearly and proximate one another. FIG. 9A also illustrates a corresponding multi-plug housing 904 including five plugs 100*a*-100*e* positioned linearly and proximate one another wherein each of the plugs 100 is electrically coupled to a single twisted pair of the cable 10*a*-10*e*. In certain examples, the multi-plug and multi-receptacle configurations of FIGS. 9A-9B can include more or fewer than five plugs 100 and receptacles 200.

FIG. 9B illustrates a multi-receptacle housing 910 mounted to a PWB 912, or any other suitable circuit board, having four receptacles 200*a*-200*d* presented in a stacked configuration, e.g. two rows of two receptacles 200. FIG. 9B also illustrates a corresponding multi-plug housing 914 including four plugs 100*a*-100*d* in a similarly stacked configuration wherein each of the plugs 100 is electrically coupled to a single twisted pair of the cable 10*a*-10*d* (note; plug 100*b* and cable 10*b* are not shown). In certain examples, the multi-plug and multi-receptacle configurations of FIGS. 9A-9B can include more or fewer rows and columns. In certain examples, the plugs 100 and/or receptacles 200 of the multi-plug and multi-receptacle configurations need not be presented in a linear orientation but can be presented in offset orientations or other suitable orientations specific to an application.

Figure 10A:
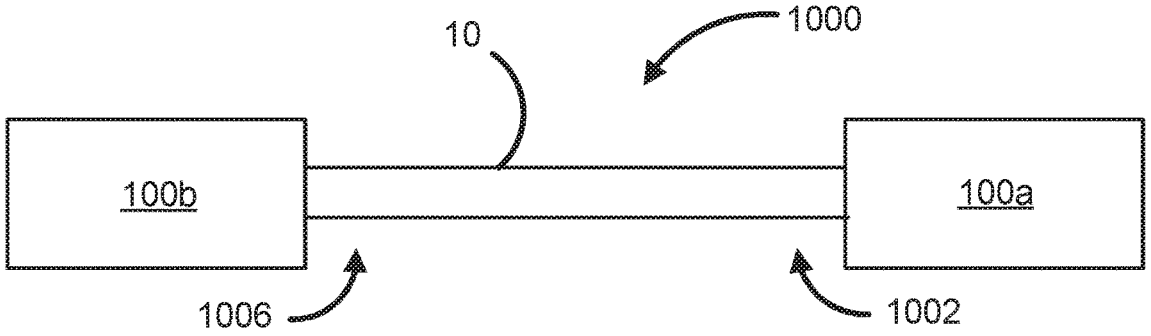
FIGS. 10A-10C illustrate various patch cord configurations utilizing the connectors of the present disclosure.
Figure 10B:
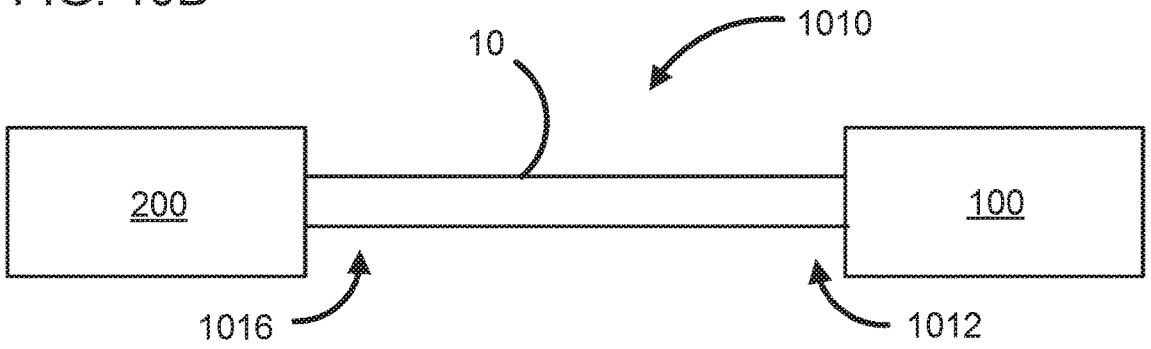
Figure 10C:
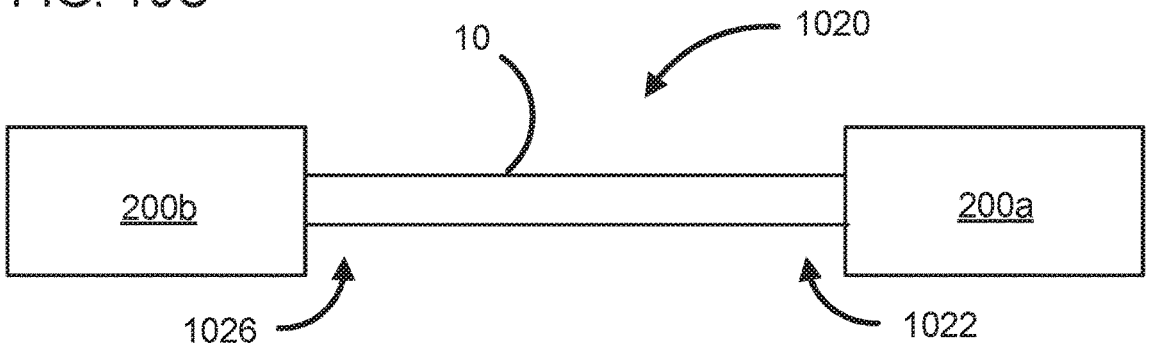

FIGS. 10A-10C illustrate various patch cord configurations that are manufacturable using the plug 100 and the receptacle 200. In the patch cord examples, each of the plugs 100 and the receptacles 200 is configured for coupling with a cable 10 having a single twisted pair of conductors (e.g. conductors 12, 14 of FIG. 1). As shown, a patch cord 1000 includes a first end 1002 with a first plug 100*a* and a second end 1006 with a second plug 100*b*, see FIG. 10A. FIG. 10B illustrates a patch cord 1010 having a first end 1012 with a first plug 100 and a second end 1016 with a first receptacle 200. FIG. 10C illustrates a patch cord 1020 having a first end 1022 with a first receptacle 200*a* and a second end 1026 with a second receptacle 200*b*.

Figure 11A:
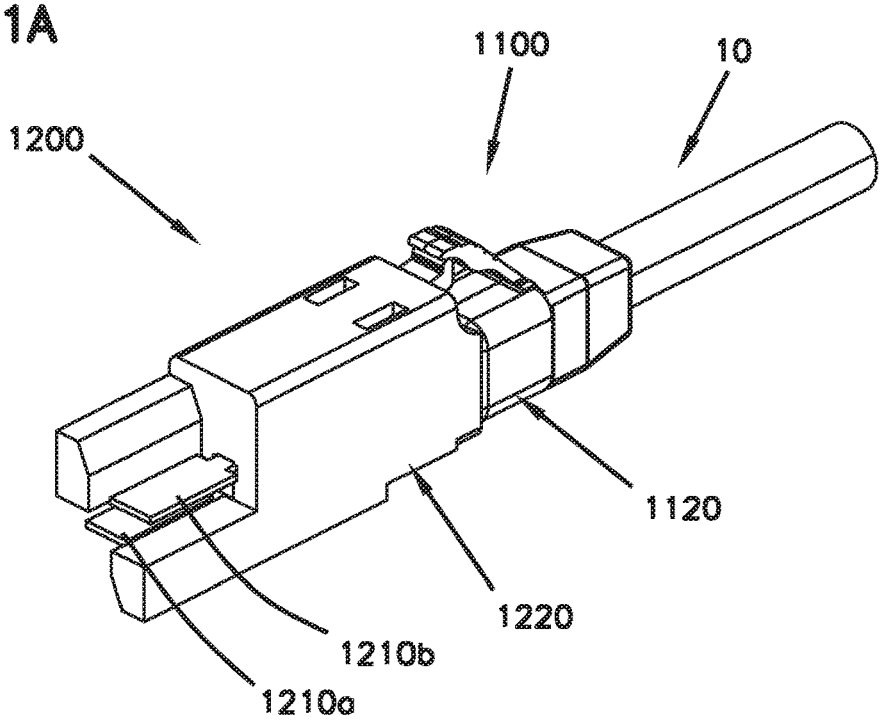
FIGS. 11A-11B illustrate example embodiments of a plug and a receptacle, according to the present disclosure, in a coupled configuration and decoupled configuration, respectively.
Figure 11B:
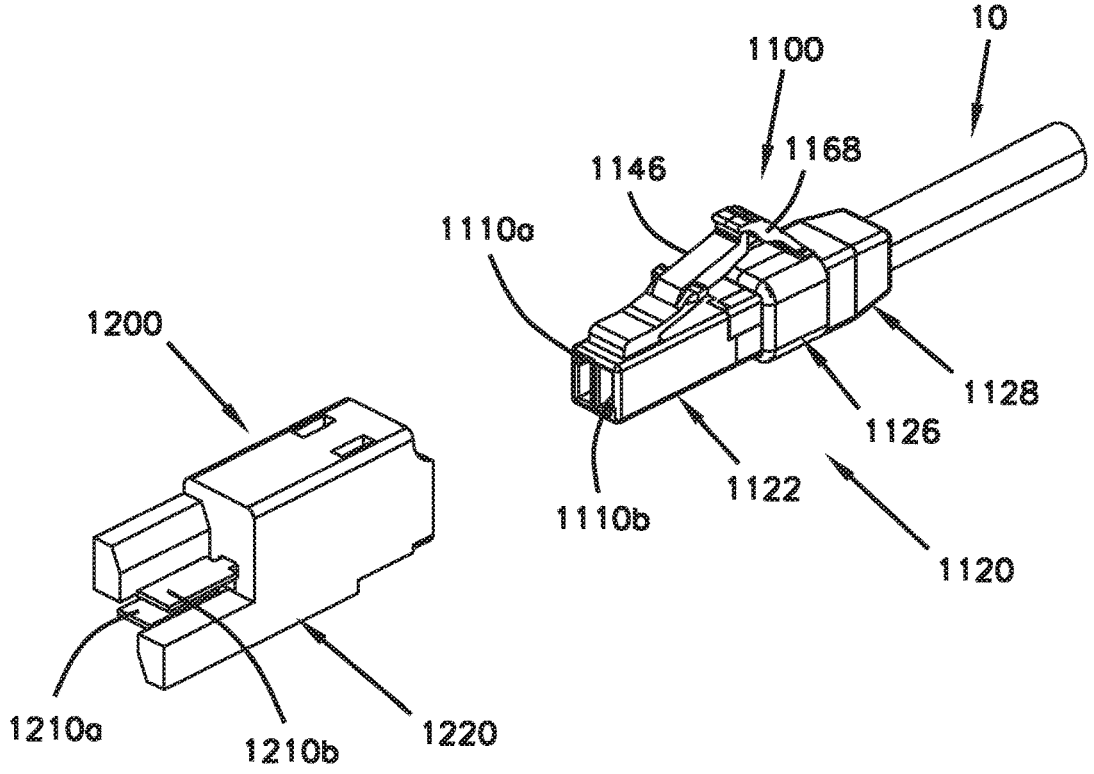
Figure 12:
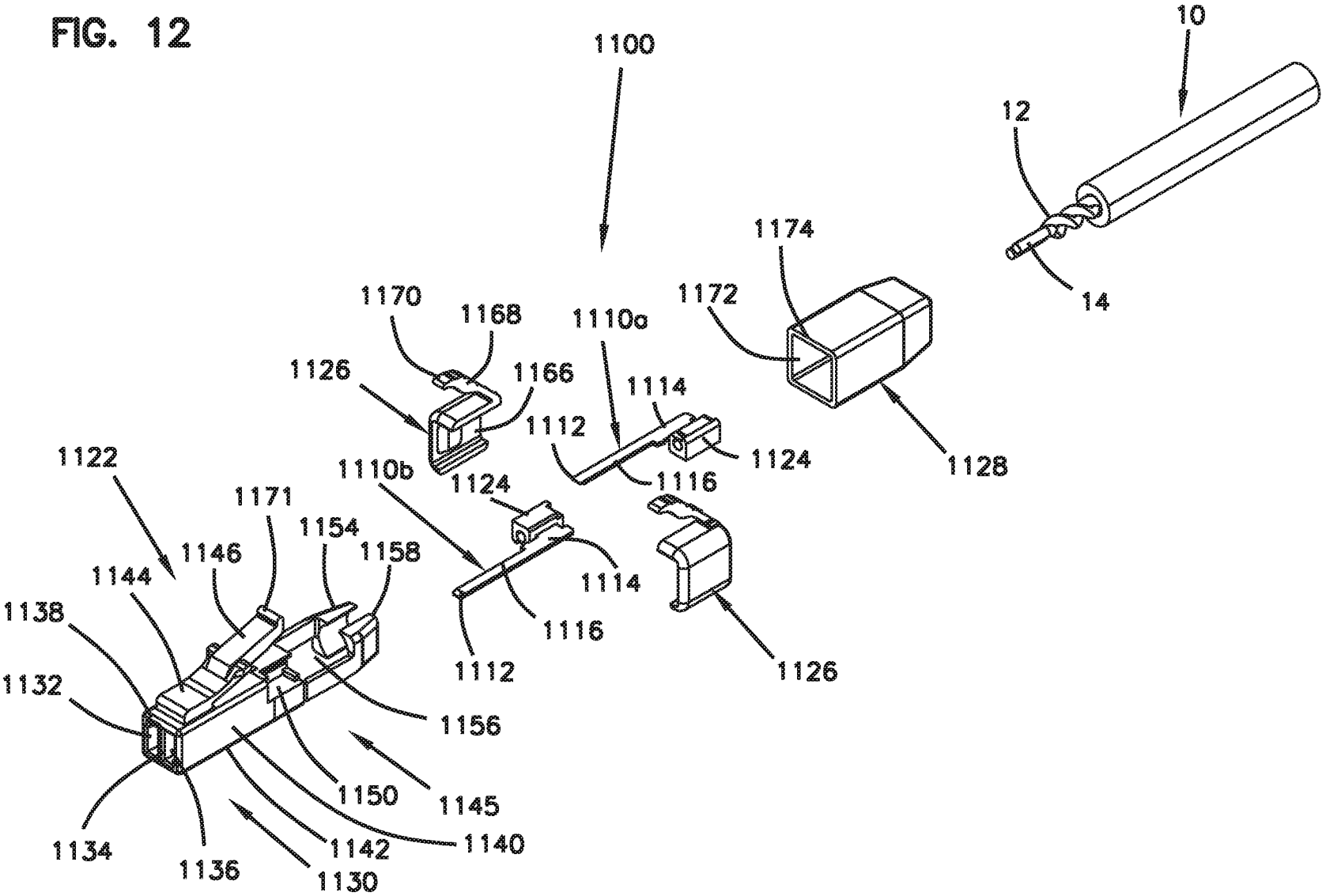
FIG. 12 is an exploded perspective view of the plug of FIGS. 11A-11B.

Referring to FIGS. 11A-15B another example embodiment of a plug 1100 and receptacle 1200 of the present disclosure can be appreciated. In certain embodiments, each of the plug 1100 and the receptacle 1200 includes a single pair of contacts with the plug 1100 including a pair of beam contacts 1110*a*, 1110*b* and the receptacle 1200 including a pair or arched beam contacts 1210*a*, 1210*b* (see FIGS. 12 and 14 for contacts). Further, each of the plug 1100 and receptacle 1200 includes a housing, e.g. housing 1120 and housing 1220, respectively. When the housing 1120 of the plug 1100 is received within the housing 1220 of the receptacle 1200, electrical coupling of beam contacts 1110*a*, 1110*b* with arched beam contacts 1210*a*, 1210*b* occurs. FIGS. 11A-11B and 12 illustrate the plug 1100 in relation to the cable 10 containing a twisted pair of conductors 12, 14.

Figure 13A:
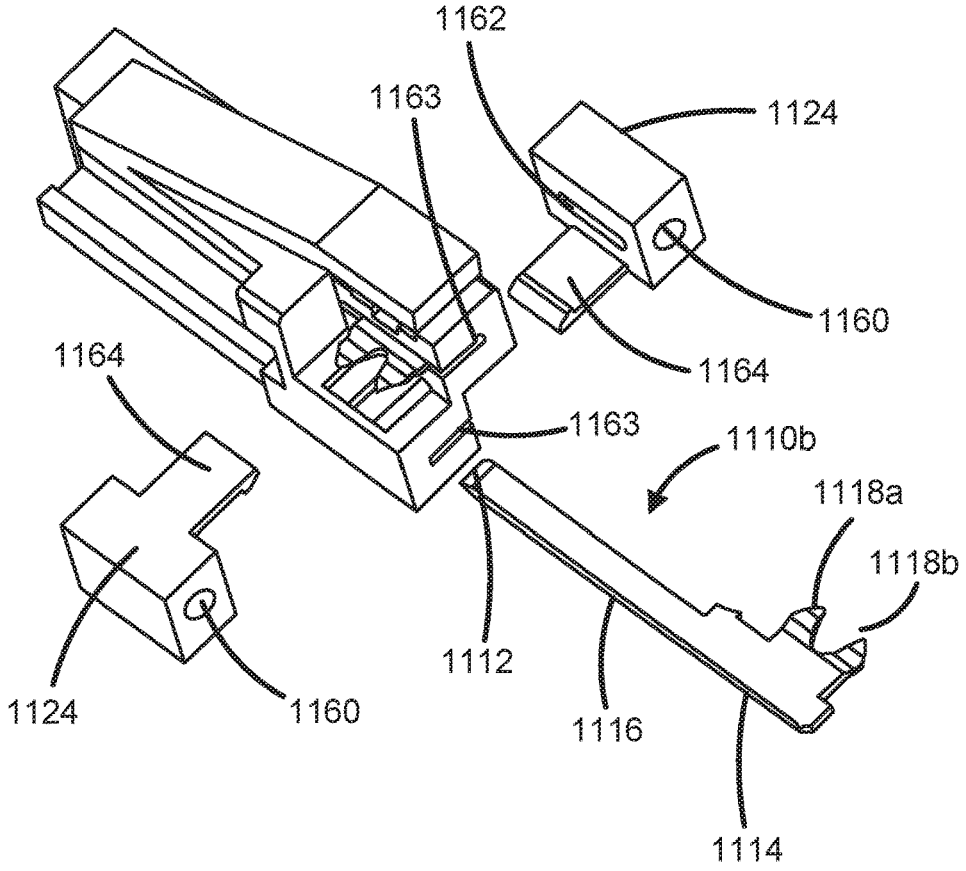
FIGS. 13A-13B provide rear perspective views of the interior configuration of a forward portion of a main body (with side walls removed) of the plug of FIG. 12.
Figure 13B:
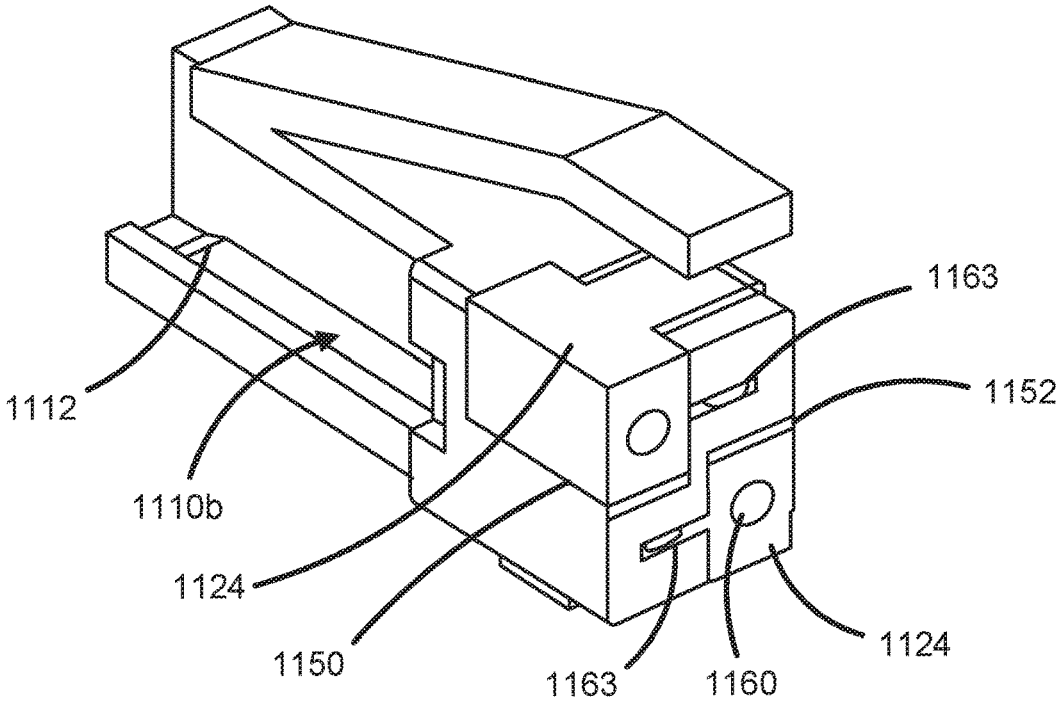

Referring to FIGS. 12 and 13A-13B, each of beam contacts 1110*a*, 1110*b* includes a forward end 1112, a rearward end 1114, and an elongate central portion 1116 connecting the forward end 1112 and the rearward end 1114. Each rearward end 1114 includes a pair of tines 1118*a*, 1118*b* that comprise an insulation piercing contact (IPC), as depicted in FIG. 13A, or that can be formed to implement a crimped, fused, welded or otherwise electrically coupled contact to one conductor, e.g. conductor 12 or 14, of a single twisted pair cable 10. In certain embodiments, the rearward end 1114 can be configured for electrical coupling to a printed circuit board (PCB) or other electrical device.

Figure 14:
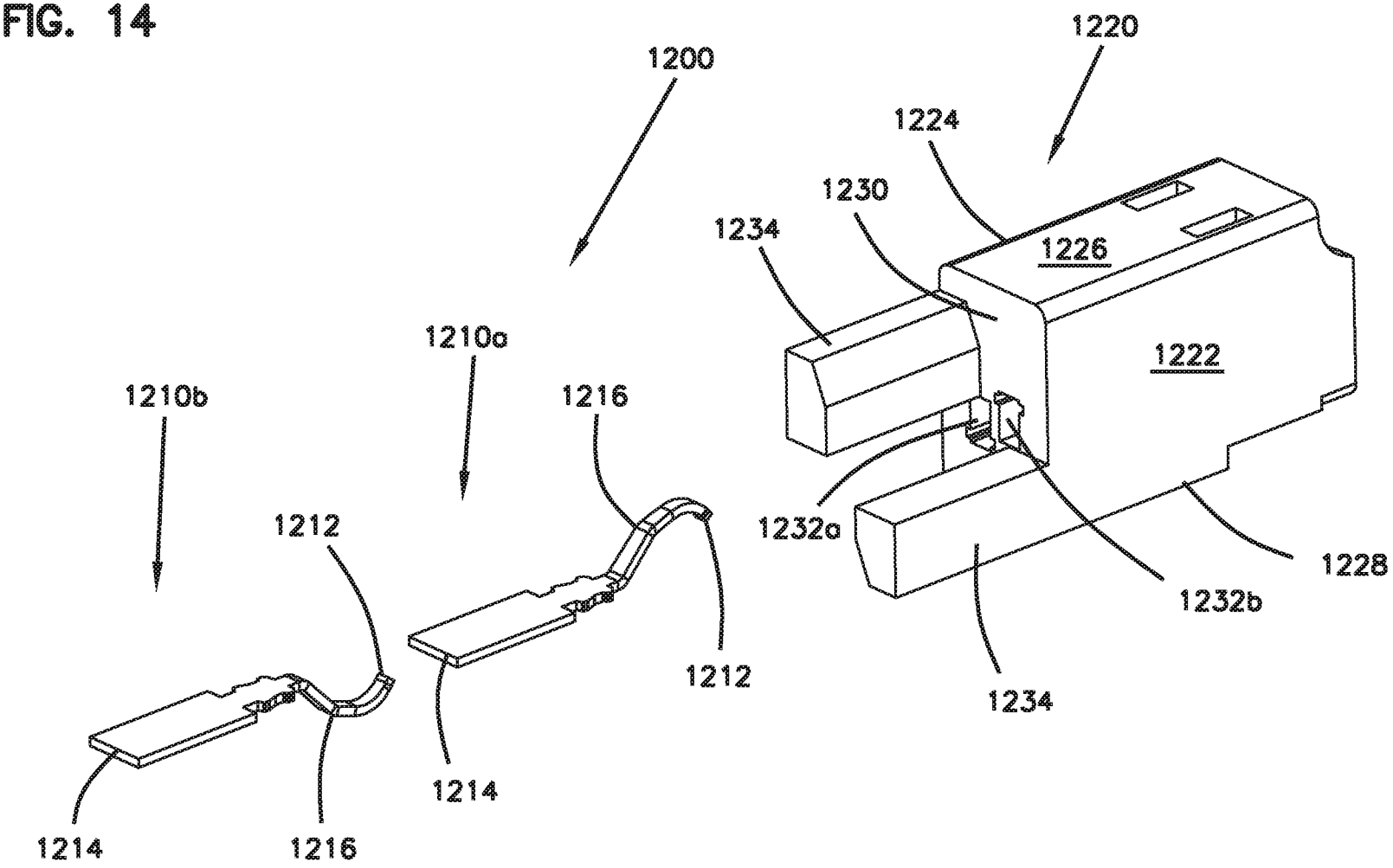
FIG. 14 is an exploded perspective view of the receptacle of FIGS. 11A-11B.

Referring to FIG. 14, each of the arched beam contacts 1210*a*, 1210*b* includes a forward end 1212, a rearward end 1214 and an arched central portion 1216 connecting the forward end 1212 and rearward end 1214. Each rearward end 1214 can be crimped, fused, welded or otherwise electrically coupled to a printed circuit board (PCB) or other electrical device. In certain embodiments, the rearward end 1214 of each of the arched beam contacts 1210*a*, 1210*b*, can be configured for electrical coupling with a conductor, e.g. conductor 12 or 14, of a singled twisted pair cable 10.

The details of the housing 1120 of the plug 1100 are best appreciated with reference to FIGS. 11B, 12, and 13A-13B. As shown, the housing 1120 of the plug 1100 includes a main body portion 1122, a pair of contact inserts 1124, an external body portion 1126, and a boot 1128.

The main body portion 1122 presents a forward portion 1130 that includes a first channel 1132 separated by a wall 1134 from a second channel 1136. The first channel 1132 is additionally bounded by a first side wall 1138 while the second channel 1136 is additionally bounded by an opposing second side wall 1140. The first and second side walls 1138 and 1140 are connected by a lower wall 1142 and an opposing upper wall 1144. The upper wall 1144 is topped with a flexible latch 1146. The first channel 1132 receives the beam contact 1110*a* at an uppermost position within the channel 1132, e.g. proximate the upper wall 1144, while the second channel 1136 receives the beam contact 1110*b* at a lowermost position within the channel 1136, e.g. proximate the lower wall 1142.

The main body portion 1122 of the plug 1100 further presents a rearward portion 1145 that includes an upper recess 1150 positioned behind the second channel 1136 and a lower recess 1152 positioned behind the first channel 1132 (see FIGS. 13A and 13B where side walls 1138, 1140 and the body extender 1154 have been removed from the illustration to provide a clearer view of the contact inserts 1124 and recesses 1150, 1152). Each of the upper and lower recess 1150, 1152 is configured to receive one of the pair of contact inserts 1124.

Referring to FIG. 12, the rearward portion 1145 of the main body portion 1122 further includes a body extender 1154 positioned behind the upper and lower recesses 1150, 1152. The body extender 1154 includes a broad cavity 1156 having an upper opening. The cavity 1156 tapers to a narrowed rear opening 1158 that is sized to accommodate and provide support the conductors 12, 14 of cable 10.

The contact inserts 1124, see FIGS. 12 and 13A-13B, are sized to fit within their respective upper and lower recesses 1150, 1152 of the main body portion 1122. Further each contact insert 1124 includes a central channel 1160 sized to accommodate a single conductor. Each contact insert 1124 additionally includes a slot 1162 that interfaces with the central channel 1160. The slot 1162 enables insertion of the tines 1118*a*, 1118*b* of one of the beam contacts 1110*a*, 1110*b* therein further enabling the tines 1118*a*, 1118*b* to pierce any insulation about the conductor and thereby establish an electrical coupling between the conductor and the respective beam contact 1110*a*, 1110*b*. With the beam contacts 1110*a*, 1110*b* electrically coupled to the conductors 12, 14 and with the contact inserts 1124 positioned within respective upper and lower recesses 1150, 1152, the central portion 1116 of the beam contacts 1110*a*, 1110*b*, extends through contact slots 1163 within the main body portion 1122 into their respective channels 1132, 1136 placing the forward end 1112 of each of the beam contacts 1110*a*, 1110*b* proximate the forward opening to the channels 1132, 1136.

As noted above, the beam contacts 1110*a*, 1110*b* are offset from one another with the beam contact 1110*a* at an uppermost position within the first channel 1132, e.g. proximate the upper wall 1144, and the beam contact 1110*b* at a lowermost position within the channel 1136, e.g. proximate the lower wall 1142. For example, the beam contacts 1110*a*, 1110*b* may be in a parallel orientation but have positions offset from one another (e.g. offset from 10 to 80 degrees, offset from 20 to 70 degrees, offset from 30 to 60 degrees, offset 40 to 50 degrees, offset by 45 degrees, etc.) such that one of the beam contacts 1110*a* is presented in a first half of the plug 1100 and the other of the beam contacts 1110*b* is presented in the second half of the plug 1100. The offset position of the beam contacts 1110*a*, 1110*b* helps to neutralize cross-talk between the pairs of contacts of proximate adjacent connectors. In certain embodiments, one or both of the pair of contact inserts 1124 includes a retaining tab 1164 to help maintain its position in the upper and lower recesses 1150, 1152 relative to the main body portion 1122 (see FIGS. 13A-13B). In certain embodiments, the external body portion 1126 is placed about the contact inserts 1124 to maintain the contact inserts 1124 position relative to the main body portion 1122.

The external body portion 1126 of the housing 1120 of the plug 1100 can be of a unitary configuration that slides over the boot 1128, which covers the rearward portion 1145 of the main body portion 1122, to cover the contact inserts 1124 or can be of a multi-piece configuration, e.g. see FIG. 12, that snaps together about the contact inserts 1124 and boot 1128. Regardless, the external body portion 1126 includes a central cavity 1166 there through that is sized to accommodate the main body portion 1122, with contact inserts 1124 in place, and the boot 1128. In certain embodiments, the external body portion 1126 further includes an upper latch coupling 1168 having a lip edge 1170 that interfaces with a corresponding lip edge 1171 on the latch 1146 of the main body portion 1122. The interface of the latch coupling 1168 and latch 1146 serves to maintain the position of the external body portion 1126 about the main body portion 1122 and boot 1128.

The boot 1128 can provide a seal about the cable 10 and/or protective covering over the conductors 12, 14 extending from the cable 10. The boot 1128 includes a central channel 1172 which generally conforms to the size and shape of the rearward portion 1145 of the main body portion 1122 including a tapering of the channel 1172 to accommodate the cable 10. The forward face 1174 of the boot 1128 is received within the central cavity 1166 of the external body portion 1126 and is held in place therewith.

Figure 15A:
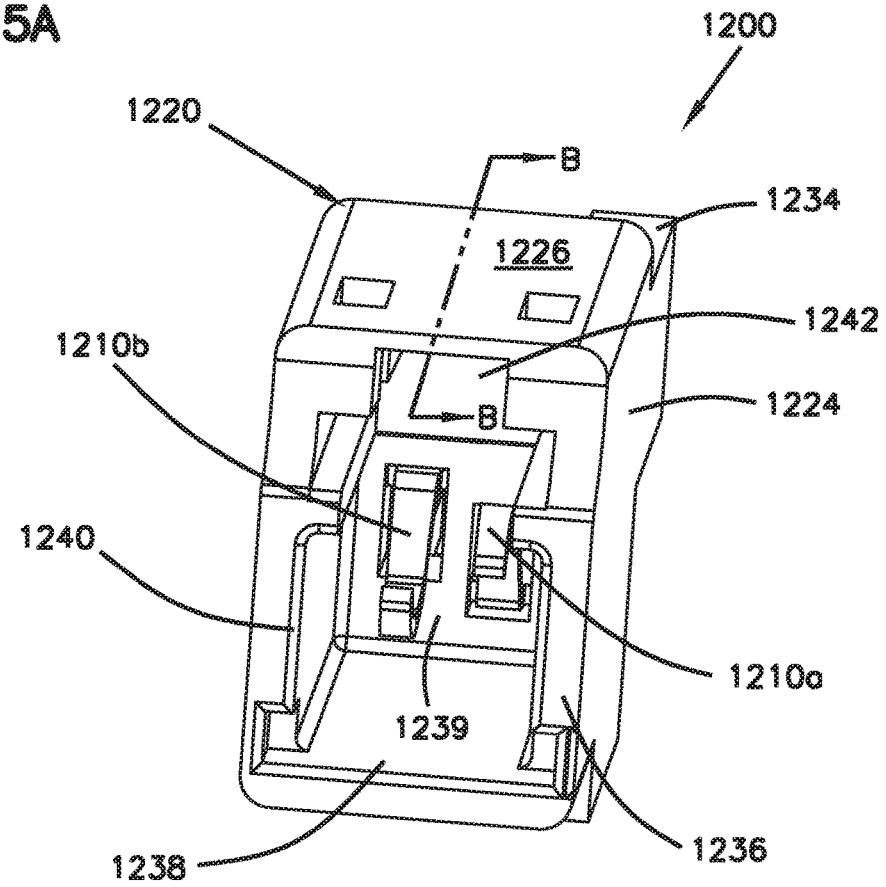
FIG. 15A is a forward perspective view of the receptacle of FIG. 14.
Figure 15B:
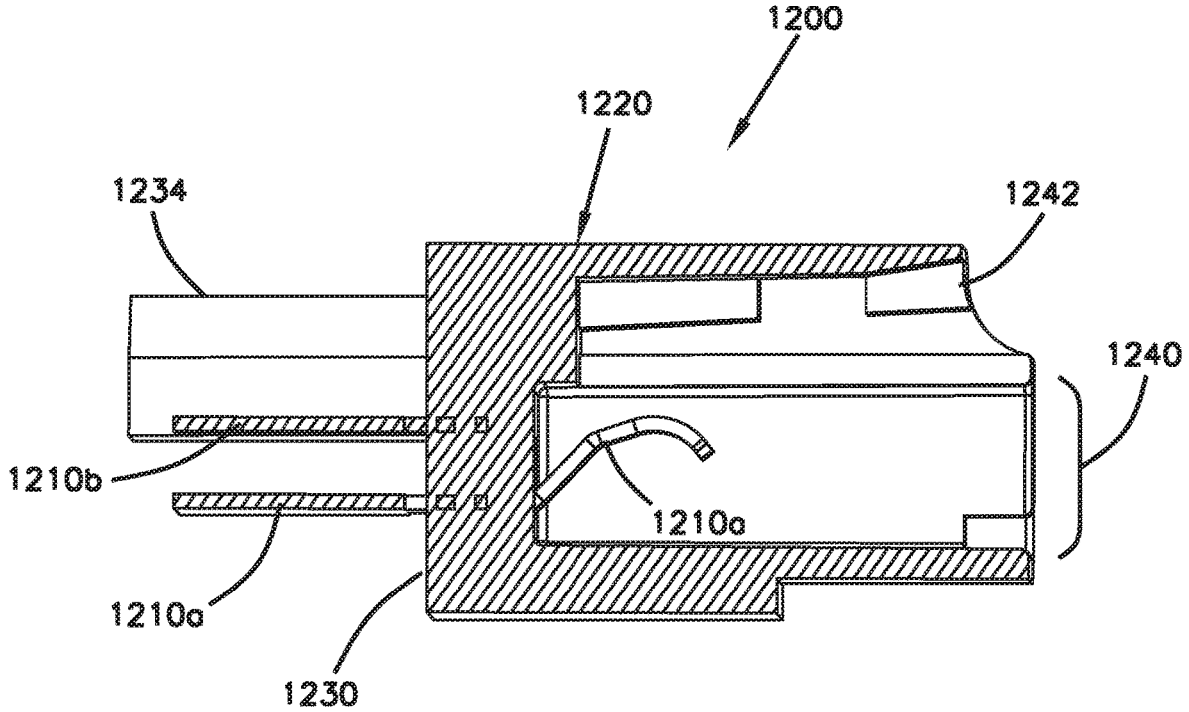
FIG. 15B is a cross-sectional view of the receptacle taken along line B-B in FIG. 14.

FIGS. 14 and 15A-15B illustrate an example embodiment of the housing 1220 of the receptacle 1200. As shown, the housing 1220 generally comprises an elongate body having a first and second sides 1222, 1224 connected by an upper face 1226 and a lower face 1228. A rear face 1230 of the housing 1220 includes first and second openings 1232*a*, 1232*b* for insertion of first and second arched beam contacts 1210*a*, 1210*b*. In certain embodiments, the housing 1220 includes one or more position/stabilizing projections 1234. A forward face 1236 of the housing 1220 presents an open channel 1238 extending from the forward face 1236 to an interior rear wall 1239. When inserted within first and second opening 1232*a*, 1232*b* the forward ends 1212 and arched central portions of the first and second arched beam contacts 1210*a*, 1210*b* extend into the channel 1238; the rearward ends 1214 the first and second arched beam contacts 1210*a*, 1210*b* extend outwardly from the rear face 1230 of the housing 1220. Notably, when within the channel 1238, the arched beam contact 1210*a* presents an upward arching contact that is positioned to interface with the beam contact 1110*a*, which is positioned uppermost in the housing 1120 of the plug 1100 while the arched beam contact 1210*b* present a downward arching contact that is positioned to interface with the beam contact 1110*b*, which is positioned lowermost in the housing 1120 of the plug 1100. The forward face 1236 of the housing 1220 includes a channel opening 1240 that is configured to receive and position the plug 1100. In certain embodiments, each of the plug 1100 and receptacle 1200 include interfacing alignment features to ensure correct positioning of the plug 1100 within the receptacle. The forward face 1236 of the receptacle housing 1220 additionally includes a notched recess 1242 that is configured to receive the flexible latch 1146 of the plug 1100; the combination of recess 1242 and latch 1146 retain the plug 1100 within the receptacle 1200 until flexing of the latch 1146 causes the plug 1100 to release from the receptacle.

Upon insertion of the plug 1100 within the receptacle 1200, the beam contact 1110*a* of the plug 1100 is placed in contact with, and electrically coupled to, the arched beam contact 1210*a* of the receptacle 1200. Similarly, the beam contact 1110*b* of the plug 1100 is placed in contact with, and electrically coupled to, the arched beam contact 1210*b* of the receptacle 1200. The wall 1134 separating the first channel 1132 of the plug 1100 from the second channel 1136 of the plug keeps the two pairs of electrically coupled contacts, 1110*a*/1210*a* and 1110*b*/1210*b*, separate. Further, the offset orientation of the pairs of electrically coupled contact helps to neutralize cross-talk between the pairs of contacts of proximate adjacent connectors.

As with the plug 100 and receptacle 200, the plug 1100 and receptacle 1200 can be utilized in adapter configurations, multi-plug and/or multi-receptacle configurations, and/or patch cord configurations as described herein. Further, as with the plug 100 and the receptacle 200, the plug 1100 and receptacle 1200 have a small form factor such as a form factor that is identical or similar to the form factor of an LC connector, a standard connector used in fiber optics. Other sizes and/or form factors are also possible. It should be noted that, while the plug embodiments have been described as presenting the beam contacts and the receptacle embodiments presenting the arched beam contacts, a reversal of contacts is also possible. For example, the plug embodiments can utilize the arched beam contacts and the receptacle can utilized the beam contacts. In another example, the plug includes one of a beam contact and one of an arched beam contact while the receptacle similarly includes one of a beam contact and one of an arched beam contact.

It will also be appreciated that aspects of the above embodiments may be combined in any way to provide numerous additional embodiments. These embodiments will not be described individually for the sake of brevity.

While the present invention has been described above primarily with reference to the accompanying drawings, it will be appreciated that the invention is not limited to the illustrated embodiments; rather, these embodiments are intended to disclose the invention to those skilled in this art. In the drawings, like numbers refer to like elements throughout. Thicknesses and dimensions of some components may be exaggerated for clarity.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention.

Spatially relative terms, such as "under", "below", "lower", "over", "upper", "top", "bottom" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity. As used herein the expression "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises", "comprising", "includes" and/or "including" when used in this specification, specify the presence of stated features, operations, elements, and/or components, but do not preclude the presence or addition of one or more other features, operations, elements, components, and/or groups thereof.

Herein, the terms "attached", "connected", "interconnected", "contacting", "mounted" and the like can mean either direct or indirect attachment or contact between elements, unless stated otherwise.

Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

What is claimed is:

1. A connector for a single twisted pair of conductors comprises:

a plug housing presenting a forward face having a z-configuration that includes a first portion offset from a second portion, the first and second portion connected by a central portion;

a first beam contact mounted within the plug housing, the first beam contact having an exposed portion proximate the first portion of the forward face, and the first beam contact having a first orientation; and a second beam contact mounted within the plug housing, the second beam contact having an exposed portion proximate the second portion of the forward face, and the second beam contact having a second orientation opposite the first orientation, wherein the first and second beam contacts are electrically coupled to first and second conductors, respectively, of a single twisted pair of conductors and wherein the first and second beam contacts transmit both power and data.

2. The connector of claim 1, wherein the plug housing includes an open forward portion having a first trough defining a first channel that receives the first beam contact and a second trough defining a second channel that receive the second beam contact.

3. The connector of claim 2, wherein the first trough and the second trough are separated by a wall that is perpendicular to both the first and second troughs.

4. The connector of claim 3, wherein the plug housing includes a rear portion having a stop block positioned proximate the wall.

5. The connector of claim 1, wherein the plug housing includes a rear portion having first and second compartments with each configured to accommodate a rearward end of first and second beam contacts, respectively.

6. The connector of claim 5, wherein each of the first and second compartments includes an opening for insertion of the first and second conductors, respectively.

7. The connector of claim 1, wherein the second orientation is 180 degrees opposite the first orientation.

8. The connector of claim 1, wherein the connector has an LC connector footprint.

9. A connector for a single twisted pair of conductors comprises:

receptacle housing presenting a forward face defining a port having a z-configuration that includes a first portion offset from a second portion, the first and second portion connected by a central portion;

a first arched beam contact enclosed within the receptacle housing, the first arched beam contact positioned proximate the first portion of the forward face, and the first arched beam contact having a first orientation; and a second arched beam contact enclosed within the receptacle housing, the second arched beam contact positioned proximate the second portion of the forward face, and the second arched beam contact having a second orientation opposite the first orientation, wherein the first and second arched beam contacts are electrically coupled to a circuit board or electrically coupled to first and second conductors of a single twisted pair of conductors, wherein the first and second arched beam contacts transmit both power and data.

10. The connector of claim 9, wherein the receptacle housing includes an alignment guide to align the first and second arched beam contacts within the receptacle housing.

11. The connector of claim 10, wherein the receptacle housing includes a first and second channel that extend from a rear face of the receptacle housing to the port.

12. The connector of claim 9, wherein the connector has footprint of an LC connector.

13. The connector of claim 9, wherein the second orientation is 180 degrees opposite the first orientation.

14. A connector for a single twisted pair of conductors comprises:

a receptacle housing presenting a forward face defining a port having a z-configuration that includes a first portion offset from a second portion, the first and second portion connected by a central portion;

a first arched beam contact enclosed within the receptacle housing, the first arched beam contact positioned proximate the first portion of the forward face; and a second arched beam contact enclosed within the receptacle housing, the second arched beam contact positioned proximate the second portion of the forward face, wherein the first and the second arched beam contacts cross over each other; and the first and second arched beam contacts are electrically coupled to a circuit board or electrically coupled to first and second conductors of a single twisted pair of conductors, wherein the first and second arched beam contacts transmit both power and data.

15. A plug and receptacle system, comprising:

a plug, having a plug housing presenting a forward face having a z-configuration including a first portion and a second portion connected by a central portion, the plug additionally having exposed first and second beam contacts positioned proximate the first and second portions respectively, the orientation of the second beam contact opposite the orientation of the first beam contact, the first and second beam contacts transmitting both power and data; and a receptacle, having a receptacle housing including a forward face defining a port that has a z-configuration including a first portion and a second portion connected by a central portion, the receptacle additionally including only first and second arch beam contacts positioned proximate the first and second portions of the port, respectively, the orientation of the second arched beam contact opposite the orientation of the first arched beam contact, wherein the port of the receptacle is configured to receive the plug placing the first arched beam in electrical contact with the first beam contact and the second arched beam contact in electrical contact with the second beam contact.

16. The system of claim 15, wherein the plug and receptacle have an LC footprint.

17. The system of claim 15, further comprising a plurality plugs having a common housing and a plurality of receptacles having a common housing.

* * * * *